US009051744B1

(12) United States Patent
Murray et al.

(10) Patent No.: US 9,051,744 B1
(45) Date of Patent: Jun. 9, 2015

(54) HAND HELD BUILDING TOOLS

(75) Inventors: Scott A. Murray, Lenexa, KS (US); Kevin A. Wolff, Chapel Hill, NC (US)

(73) Assignee: Exceptional IP Holdings, LLC

( * ) Notice: Subject to any disclaimer, the term of this patent is extended or adjusted under 35 U.S.C. 154(b) by 279 days.

(21) Appl. No.: 13/220,606

(22) Filed: Aug. 29, 2011

Related U.S. Application Data

(63) Continuation-in-part of application No. 12/837,707, filed on Jul. 16, 2010, now Pat. No. 8,286,297, which is a continuation of application No. 11/371,388, filed on Mar. 9, 2006, now Pat. No. 7,784,143.

(60) Provisional application No. 60/660,460, filed on Mar. 11, 2005.

(51) Int. Cl.

| | |
|---|---|
| ***E04F 21/32*** | (2006.01) |
| ***E04F 21/16*** | (2006.01) |
| ***B05C 17/10*** | (2006.01) |
| ***B26B 9/00*** | (2006.01) |
| *A47L 13/08* | (2006.01) |

(52) U.S. Cl.
CPC ..... *E04F 21/32* (2013.01); *E04F 21/161* (2013.01); *B26B 9/00* (2013.01); *B05C 17/10* (2013.01); *A47L 13/08* (2013.01)

(58) Field of Classification Search
USPC ..... 15/235.4, 235.6, 236.01, 236.06, 15/236.08, 245.1; 30/169; 148/588, 639; 407/118, 119
See application file for complete search history.

(56) References Cited

U.S. PATENT DOCUMENTS

| | | | | |
|---|---|---|---|---|
| 1,352,140 | A | 9/1920 | Napier | 83/835 |
| 2,306,187 | A | 12/1942 | Ronan | 83/835 |
| 2,326,674 | A | 8/1943 | Pavitt | 148/573 |
| 2,327,129 | A | 8/1943 | Ronan | 148/588 |
| 2,395,186 | A | 2/1946 | Jones | 15/235.6 |
| 2,829,684 | A | 4/1958 | Lagerstrom | 83/852 |
| 3,136,056 | A | 6/1964 | Reynier | 30/47 |
| 4,285,124 | A | 8/1981 | Diakonov | 30/31.1 |
| 4,860,452 | A | 8/1989 | Guarnaccia et al. | 30/346.6 |
| 6,134,743 | A | 10/2000 | Schmidt | 15/236.01 |
| 6,568,087 | B1 | 5/2003 | Gringer | 30/169 |
| 2005/0217050 | A1 | 10/2005 | Meyers | 15/235.4 |

FOREIGN PATENT DOCUMENTS

| | | |
|---|---|---|
| CH | 687182 | 10/1996 |
| DE | 29913825 | 11/1999 |
| JP | 59-50120 | 3/1984 |

*Primary Examiner* — Mark Spisich
(74) *Attorney, Agent, or Firm* — Wolff Law Offices, PLLC; Kevin Wolff

(57) ABSTRACT

The present invention is directed generally to tools that are made, at least in part, more durable, particularly one or more working surface(s) of the tools. For example, various tools such as trowels, knives, and scrapers may be made having at least a portion of their blades heat treated to make at least their working edges more durable and extend their useful lives. For example, in various embodiments, a putty knife, taping knife, or scraper blade may have at least one working surface or edge that has been at heat treated while an area of the blade where a handle is permanently attached is not heat treated.

20 Claims, 36 Drawing Sheets

1700

HAND HELD BUILDING TOOLS

This patent application claims priority to, and is a continuation-in-part of U.S. patent application Ser. No. 12/837,707, filed on Jul. 16, 2010, now U.S. Pat. No. 8,286,297, which is a continuation of U.S. patent application Ser. No. 11/371,388, filed on Mar. 9, 2006, now U.S. Pat. No. 7,784,143, which claims benefit of U.S. Provisional Patent Application No. 60/660,460, filed Mar. 11, 2005. These prior patent applications are hereby incorporated herein by reference for all purposes.

FIELD OF THE INVENTION

The present invention pertains to methods and various apparatus for building tools. For example, the invention involves methods and various apparatus for high quality durable building tools.

BACKGROUND

Various building tools have been known in the past for applying, molding, smoothing, and/or texturing material of a working surface with, for example, cement, adhesive, etc. to build, for example, a building. One particular type of building tool for applying, molding, smoothing and/or texturing materials is known as the trowel. Some types of trowels include, for example, a finishing trowel, a swimming pool trowel, and notched trowels of various kinds. These trowels are typically comprised of a blade that contacts the working surface and a handle attached to the blade for a person to grab and move the blade around on a working surface. The trowel blades have various different shapes that are designed for various applications (type of work). During use, the trowel may be used or moved at an angle relative to the working surface so that the outer edges of the trowel experiences friction and wear, such that the trowel edge may become worn out and no longer retain its original shape. Further, if the trowel is dropped the outer edges of the trowel blade may be bent so that in use the trowel does not make the desired working surface shape or result. Therefore, trowel blade durability is an important characteristic for determining the useful life of a trowel, and the durability of the outer edges of the trowel is particularly important.

SUMMARY

The present invention is directed generally to building tools that are high quality, durable, and strong. For example, various tools that have blades made of a material such as metal that wear through use may have the blades, or portions thereof, that are manufactured to be more durable and have a longer lasting useful life. For example, portions of the blades may be heat treated and cooled so as to harden or strengthen them for improved quality, durability, and strength performance. The invention is particularly useful for building more durable tools that have thin or flat blades. Such tools may include, for example, tools for the building trades including trowels, knives, and scrapers. In one embodiment, a texturing trowel may have one or more portions of its blade heat treated to improve the quality, durability, and strength performance. In one variation, the texturing trowel may have at least a first texturing edge or side of trowel blade heat treated to reduce blade wear or damage so that the quality, durability, and strength of the texturing edge is increased. In another variation, the texturing trowel may have at least a first texturing edge and a second texturing edge that are heat treated for reduced blade wear or damage, the first texturing edge and second texturing edge may be locate on opposite sides of the blade. The texturing edge may be in the shape of, for example, a square notch (or square tooth), a V notch (or triangle tooth), a rounded tooth with a semi-circle or square notch (semi-circle tooth), etc. In one variation, the blade may have various texturing edges of different shapes so that one texturing edge is a different shape than another texturing edge. In another variation, the entire blade may be heat treated and cooled.

In another embodiment, the tool may be, for example, a finishing trowel having one or more portions of the blade heat treated and cooled to harden or strengthen it. For example, the working edges of the finishing trowel blade may be flat, smooth and/or non-texturing edges that are heat treated and cooled to harden or strengthen the edge(s) so as to reduce blade wear or damage so that the quality, durability, and strength of the working edge is increased. In a still further embodiment, the tool may be, for example, a swimming pool trowel having one or more portions of the blade heat treated and cooled to harden or strengthen the blade where desired. For example, the working edges, that may include rounded ends of the trowel blade, may be heat treated and cooled to harden or strengthen the edge(s) so as to reduce blade wear or damage so that the quality, durability, and strength of the working edge is increased. In variations, the working edges of the swimming pool trowel may include texturing, may be rounded, and may be heat treated and cooled. Of course, the heating and cooling process of the present invention for hardening or strengthening blades may also be applied to other tools, for example, putty knifes, paint scrapers, notched margin trowels (V and/or square notches), notched taping knifes, brick trowels, pointing trowels, margin trowels, etc., which are made of a non-disposable blade construction preferably having the blade and working edge of the blade securely mounted to or integrally formed with a handle or a handle connecting mechanism. As such, these tools will last longer and will not need to be thrown away or have the blades reworked by, for example, sharpening (not replacing the blade) as often.

BRIEF DESCRIPTION OF THE DRAWINGS

The objects, features and advantages of the present invention will become more readily apparent to those skilled in the art upon reading the following detailed description, in conjunction with the appended drawings, in which.

DETAILED DESCRIPTION

The present invention is directed generally to tools that are high quality, stronger, and more durable. As such, the present invention includes various embodiments showing methods and apparatus for building tools that may be, at least in part, made of a material that is heat treated and cooled so as to make its working surface more durable and longer lasting. For example, various tools that have blades made of a material such as metal that wear through use may have the blades, or portions thereof, that are heat treated and cooled so as to harden or strengthen them for improved quality, durability, and strength performance. The invention is particularly useful for building tools with thin or flat blades with edges that will wear through use. The invention is also particularly beneficial to building tools having a texturing surface that is more likely to wear out and lose its original shape. As one skilled in the art will appreciate, the building tools described herein are formed of structures and with designs that are intended to have permanent non-disposable blades which is securely fastened to a handle and/or a handle connection means such that a user would rather throw the worn out tool in the trash when the blade is damaged or worn out to the point where it can not achieve its intended use, and get a completely new tool including a new handle, blade, and handle-to-blade connection mechanism. As such, the present invention of heat treating the blade of these building construction tools allows the blade to last 3-4 times longer without adding the complexity and/or risk of failure in use of a disposable blade mechanization system.

Figure 1:
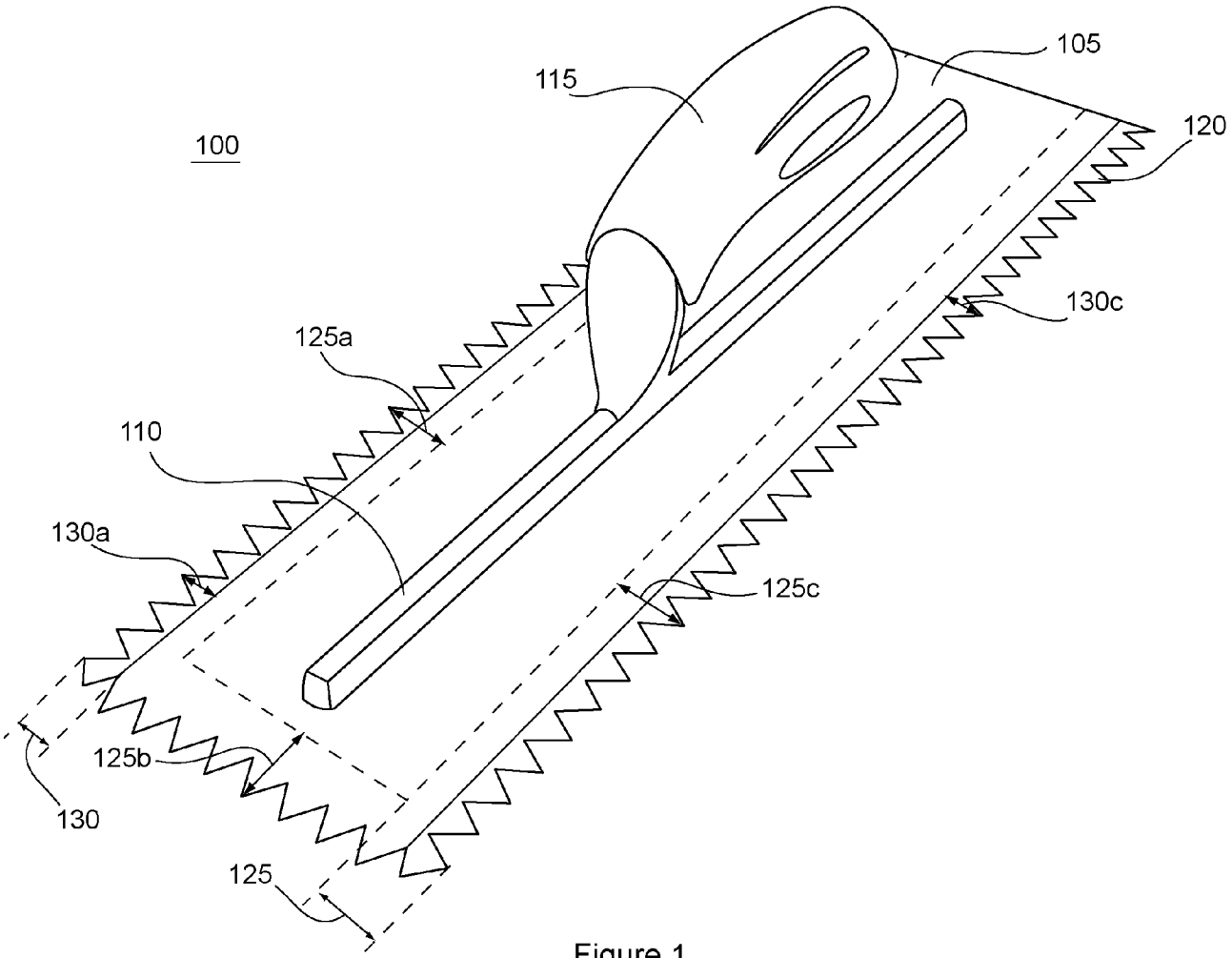
FIG. 1 illustrates a perspective view of a first texturing trowel, according to at least one embodiment of the invention.
Figure 2:
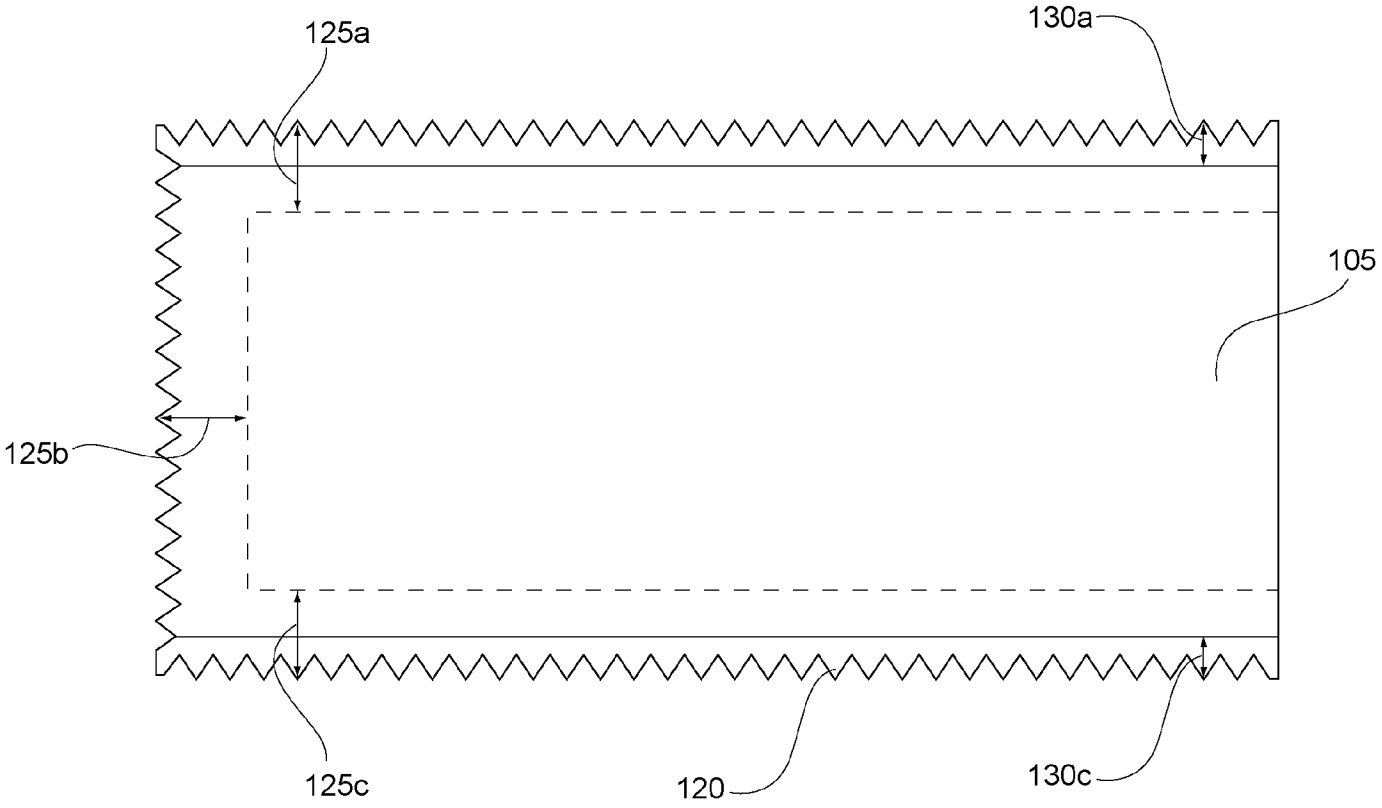
FIG. 2 illustrates a top view of the blade of the texturing trowel shown in FIG. 1, according to at least one embodiment of the invention.
Figure 3:
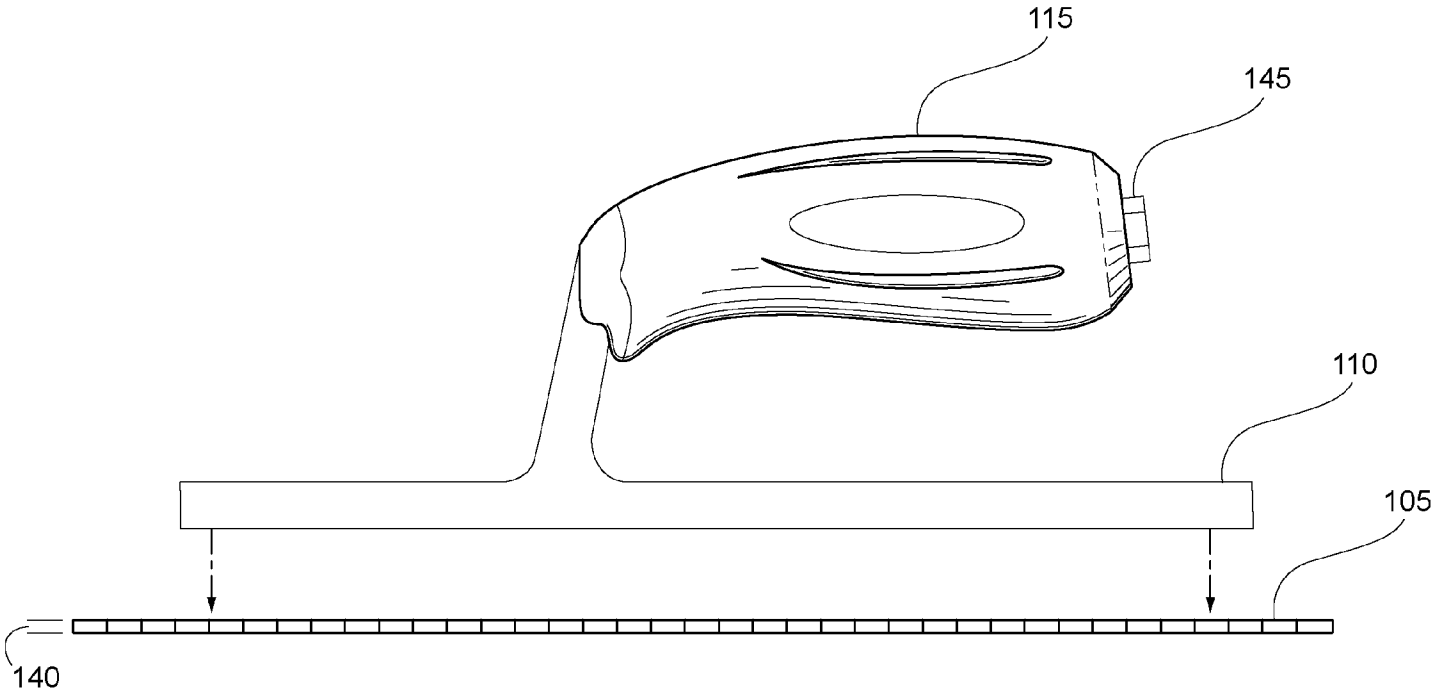
FIG. 3 illustrates a side view of the blade and handle of the texturing trowel shown in FIG. 1 prior to assembly together, according to at least one embodiment of the invention.

Referring to FIGS. 1-3, a texturing trowel 100 according to one embodiment of the invention is presented. The texturing trowel 100 may be a V notch trowel used to apply, for example, a cement or adhesive, to a building surface. The V notch trowel may include a blade 105 that may be made of a metal, for example, high carbon steel or other material suitable for acting as a blade 105 of the V notch trowel. The high carbon steel may be of a type ranging between, for example, AISI 1060 high carbon steel and AISI 1095 high carbon steel, which may be a rolled steel sheet that may be cut, punched, or machined to the size of the blade 105. The AISI 1060 Steel may be an alloy including by weight percentage; C of 0.55-0.66, Fe of 98.35-98.85, Mn of 0.6-0.9, P of a maximum 0.04, and S of a maximum 0.05. The AISI 1095 steel may be an alloy including by weight percentage; C of 0.9-1.03, Fe of 98.35-98.8, Mn of 0.3-0.5, P of a maximum 0.04, and S of a maximum 0.05. The blade 105 may be relatively thin, having a thickness 140 that may be, for example, in the range of 1/16 to 1/64 an inch. The V notch trowel 100 may have a tang 110 made of a metal, for example aluminum, that is coupled to the blade 105 by, for example, welding, brazing, etc. A handle 115 made of, for example, wood, plastic, and/or rubber, may be couple to the tang using, for example a threaded nut 145, bolt, etc. In this case, the trowel is a V notch trowel 100 and thus may have teeth, for example, teeth 120, along one or more of its blade edges. In this case, the V notch trowel blade has teeth 120 along three of its four sides. There may be many different notch sizes that may result in many different total numbers of teeth on one or more sides of the trowel.

In use, the V notch trowel 100 may be placed at an angle, for example, a 45 degree angle relative to the working surface so that the teeth 120 may contact the working surface only at their points or apex. Used in this manner for spreading, for example, cement or adhesive, the working surface and the cement or adhesive have a textured material shaped in the shape of the V notch or grooves of the trowel. However, due to the friction of the teeth on the working surface or materials being spread on the working surface, the teeth, especially the points of the teeth may be worn down over time resulting in a thinner texturing than desired. As a result, the trowel 100 would need to be reworked or replaced by a new trowel. From this embodiment and this statement of the need to rework or replace the trowel more without using the present invention, one skilled in the art will clearly appreciate that the invention is particularly applicable to buildings tools that are designed and constructed to have a permanent blade, not designed or intended to use replaceable or disposable blades, so that when the blade wears out or looses its intended shape or performance for its intended purpose the entire tool (not just the blade) would need to be thrown away and a new one purchased, or the blade would have to be reworked through manual labor to conform with its original shape or sharpness to work properly for its intended purpose. So, to overcome this problem according to the present invention, at least a portion of the outer edges of the V notch trowel blade, e.g. the outer portion 130 including the teeth 120 may be heat treated and cooled so as to produce a hardened portion of the blade that is more resistant to wear during extensive use. Although the entire blade 105 may be heat treated and cooled to increase the hardness, strength and durability of the outer portion of the teeth 120, testing has shown that in some cases heat treating the entire blade may result in a blade that is too brittle and breaks more easily if dropped, during the assembly process, for example, when attaching the tang 110 or handle 115 to the blade 105, or under the pressure applied during repeated use. However, proper selection of the material used to make the blade 105 and the method used in heat treating the blade 105 may help to reduce or solve this problem. In any case, the teeth 120 are harder, stronger and more durable and may last longer within the desired height tolerance, for example up to 3 to 5 times longer. This approach is used in to solve the problems encounter in the art, in contravention to a disposable blade approach that may be used for some other devices where the blade wears out quickly and is far less expensive or integral to the device (e.g., disposable razor blades). Therefore, one skilled in the art will appreciate that the present invention and building construction tools, including the present embodiment related to a notched trowel, are according to the present invention made of a non-disposable blade construction preferably having the blade securely mounted to a handle or a handle connecting mechanism, such as a trowel tang, and these tools will last longer and will not need to be thrown away or have the blades reworked by, for example, manual or machine sharpening (not replacing the blade) as often.

In this embodiment, the heat treatment may be performed on, for example, the two longest sides so as to heat treat and harden only the two primary working edges of the trowel 100. As shown more clearly in FIG. 2, the heat treatment may be performed on narrow areas, for example, areas 130*a* and 130*c* (width distance from the tip of the tooth 120 to the solid line) running along the length of the trowel blade 105. Selecting to heat treat only two edge areas 130*a* and 130*c* may help to protect the most often used edges of the trowel and minimize the setup time and complexity for heat treating the desired portions of the trowel. Although in this case the distance 130*a* and 130*c* is shown to be greater than the height of the teeth 120, the distance 130*a* and 130*c* may be less than the height of the teeth 120 as will be illustrated more clearly in a later described embodiment. The distances from the tip of the teeth 120 to the dotted lines 125*a* and 125*c* indicate areas where the trowel blade 105 may be cleaned prior to the heat treating process as described in more detail below. In one variation, the front edge (the b side) and/or the back flat edge (the d side) of the blade 105 may be cleaned (e.g., area 125*b*) and the heat treated 130*b* (not shown).

Figure 4:
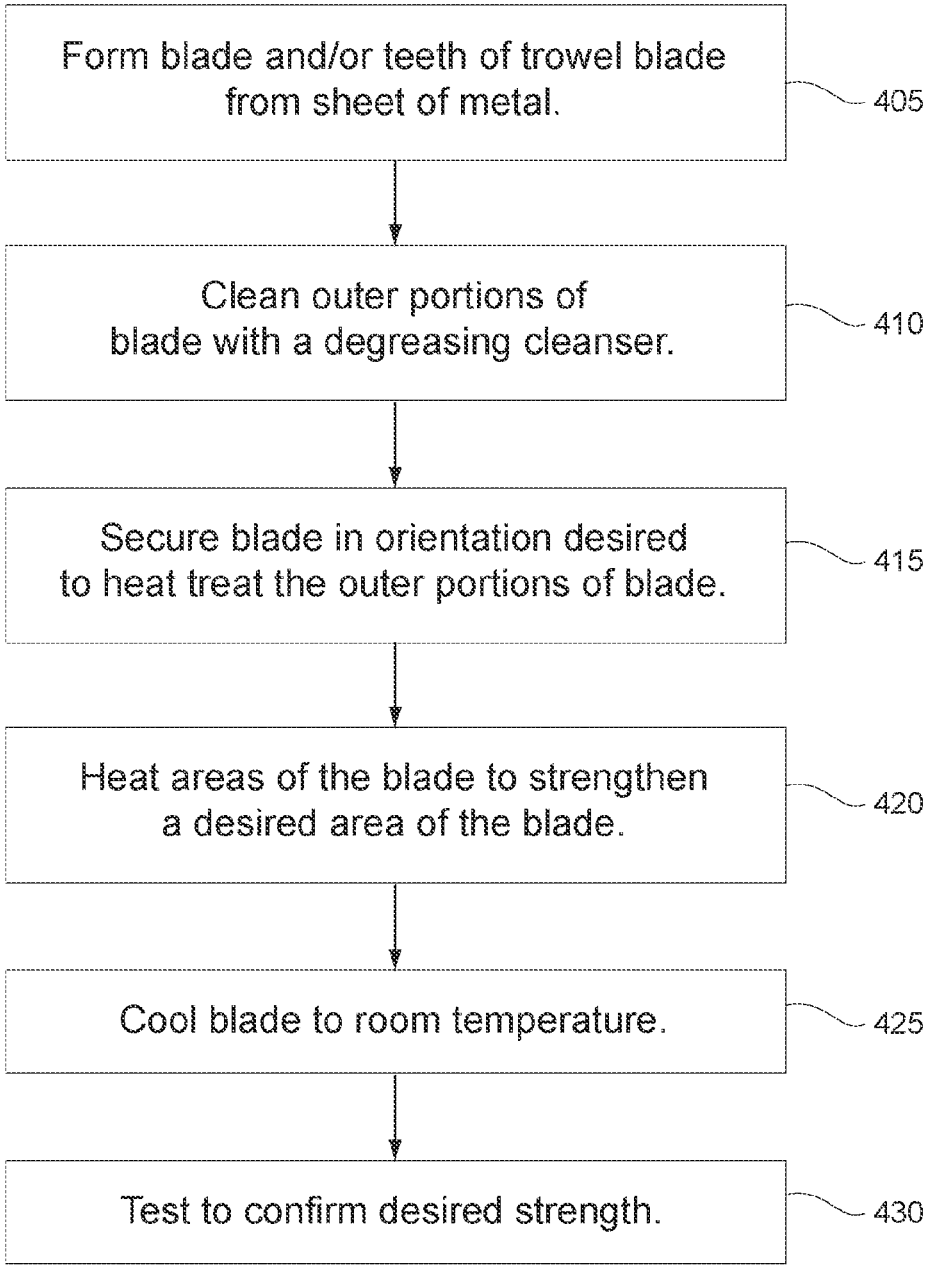
FIG. 4 is a flow chart of a process for making a heated treated tool, according to at least one embodiment of the invention.

Referring to FIG. 4, a flow chart of a process for making a heated treated tool according to at least one embodiment of the invention is provided. First, at 405 a blade with or without notches or teeth is formed from a sheet of material, for example, a metal sheet. As mentioned above, the metal may be a high carbon steel such as AISI 1060 steel or AISI 1095 steel to name a few. The shape of the blade may be formed by, for example, stamping, cutting, forming, grinding, etc. Next, at 410, at least an outer portion of the blade may be cleaned with a degreasing cleanser. The degreasing cleanser may be an alcohol base cleanser that removes dirt and grease to improve the possibility that the heat treating process may be capable of achieving a consistently higher hardness and strength of the material. Although the entire blade 105 may be cleaner at this step, for greater efficiency and lower cost, the area cleaned may be, for example, up to ½ an inch further into the blade than the area to be heat treated, e.g., the distance 125 to be degreased may be greater than the distance 130 to be heat treated. In any case, at least the area to be heat treated should be cleaned, i.e., at least a portion of the outer edge or working edge of the trowel. Next, at 415, the blade 105 may be placed in a blade transporting and/or blade holding equipment and secured in an orientation desired for heating the targeted portion of the blade 105. For example, the blade 105 may be held with a pneumatic clamp or other clamping device that allows the area 130*a* and 130*c* to be heat treated to remain exposed and may shield the rest of the blade 105 from the heat treatment. The blade 105 may be held in, for example, a parallel orientation to the heat treatment equipment that is located along either side (a and c) of the blade 105 so that both sides of the blade 105 may be treated simultaneously.

Next, at 420, at least a portion of the blade 105, for example, areas 130*a* and 130*b*, are heated to a desired temperature to harden and strengthen the edge portions and/or teeth 120. The heat treatment equipment may be, for example, an electric induction heating machine, a furnace, etc, that can heat at least a portion of the blade 105 up to the desired temperature. In the case of an electric induction heating hardening is done by heating the metal with a high frequency alternating magnetic field. Heat is generated by high frequency eddy currents and hysteresis currents on the outer surfaces to be hardened. The primary current may be carried by a water cooled copper electrode. The part to be hardened typically serves as the second electrode in the circuit. Induction heat treating is very fast. Induction hardening of trowel teeth may be accomplished by having the blade 105 stationary and activating the heat treatment equipment for a short period of time or by moving the blade 105 at the appropriate speed on, for example, a conveyor belt through the location where the heat treatment equipment is located. It is understood that those skilled in the art of induction heat treating will know that the range of operating frequency, heating temperature achieved, exposure time at temperature, and cooling rate will vary based on the type of material used to make the blade 105 (e.g., high carbon steel ranging from 1060-1095 steel), the original hardness of the material, the desired final hardness, and the specific geometry for the portions of the blade 105 that are being heat treated, e.g., the edges of the blade. Then at 425, the blade 105 may be cooled to, for example, room temperature and/or ambient temperature rapidly as through, for example, water cooling. Room temperature may vary in a range of, for example, approximately 5 degrees C. to 36 C, depending on the season and/or conditions in the heat treating facility. Alternatively, the blade could be cooled to ambient or room temperature in a controlled temperature chamber to achieve different hardness and/or strength. Further, the blade may be exposed to a second heating and cooling cycle to temper the heat treated portion of the blade. Then at 430, a confirmatory test may be performed on the edge or teeth to ensure that the proper hardness has been achieved by the heat treatment. For example, the target hardness may be in a range of approximately 57 to 61 HRC when using, for example, a heat treated blade 105 made of high carbon steel 1095. An untreated blade 105 made of high carbon steel 1095 may have a hardness target or, for example, 44-47 HRC. Other materials may result in different pre and post heat treating target hardness. The result is a blade that is harder, stronger and more durable, having a longer expected life.

After testing, as illustrated in FIG. 3, the tang 110 and handle 115 may be attached to the blade 105 by, for example, welding, brazing, screws, or any other attachment means that is available. Of course, the heat treating may be performed with the tang 110 and handle 115 already attached to the blade 105. Although, this may complicate the manufacturing process or adversely affect the coupling between the blade 105 and tang 110. In general, it is simpler and easier to heat treat the blade 105 prior to assembly with the tang 110 and handle 115. This process may be applicable regardless of the type or style of blade 105 that is used. Although the process has been described as being applied to an example where two edges of the blade 105 are heat treated, one, two, three, four, or any number of edges, portions or the entire blade 105 may be heat treated to increase its hardness, strength and durability of the desired areas.

Figure 5:
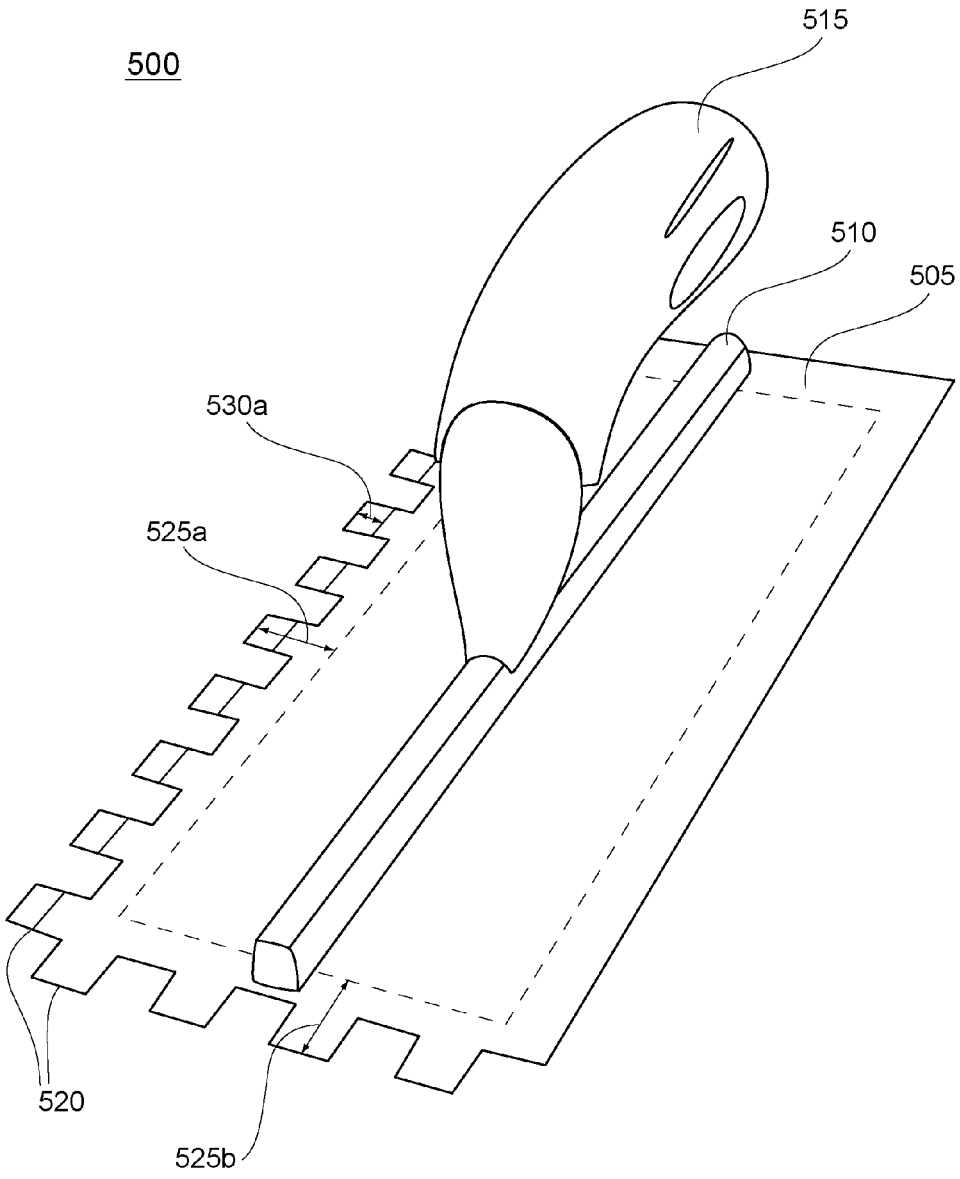
FIG. 5 illustrates a perspective view of a second texturing trowel, according to at least one embodiment of the invention.
Figure 6:
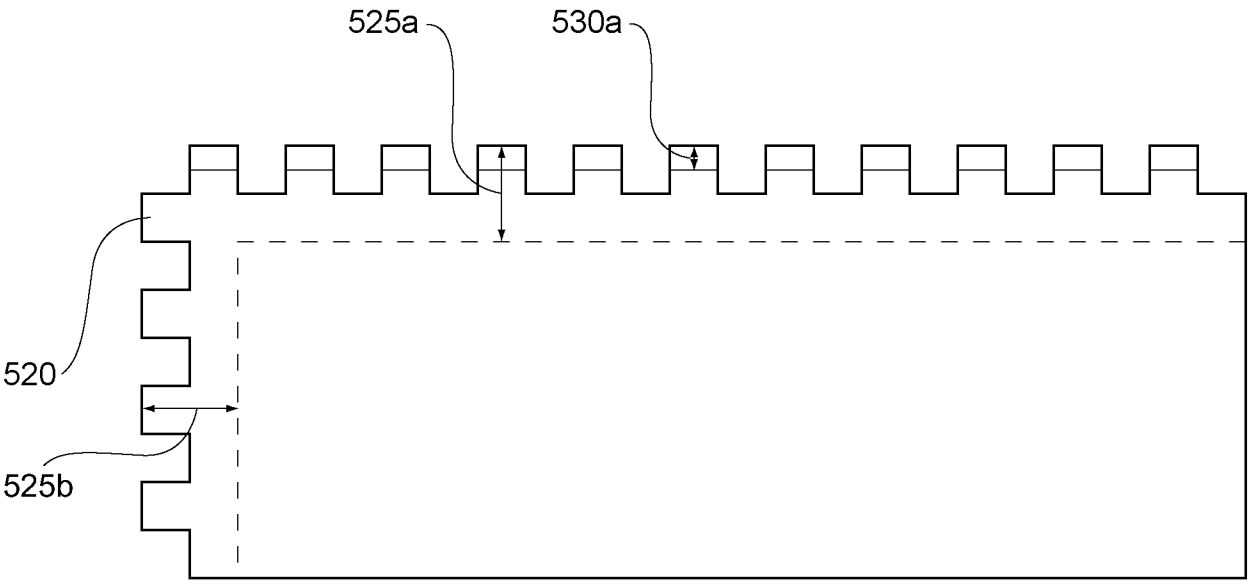
FIG. 6 illustrates a top view of the blade of the texturing trowel shown in FIG. 1, according to at least one embodiment of the invention.

Referring to FIGS. 5 and 6, a perspective view and a top view (without the tang and handle) of a second texturing trowel 500 is provided. The second texturing trowel 500 may have a trowel blade 505 made of a material, for example, a metal. The metal may be, for example, a high carbon steel ranging between AISI 1060 steel and AISI 1095 steel to name a few. In this example, the texturing edge may be in the shape of, for example, a square notch or square teeth 520. Further, the square notch or teeth 520 may be partially heat treated as shown by distance 530*a*, or completely heat treated similar to the embodiments shown in FIGS. 1-3. In this case, the heat treatment 530*a* is shown along only one side or edge of the trowel blade 505, side a. However, it is understood that the heat treatment may be applied to any and all areas of the trowel blade 505. The heat treatment may be performed using, for example, the process described with respect to FIG. 4 or a similar process for hardening the blade 505 material so that it is more durable, strong, and long lasting. As such, the blade 505 may be cleaned along one or more sides to be heat treated as indicated shown by the dotted line area, for example areas 525*a* and/or 525*b*, etc., prior to being heat treated.

Figure 7:
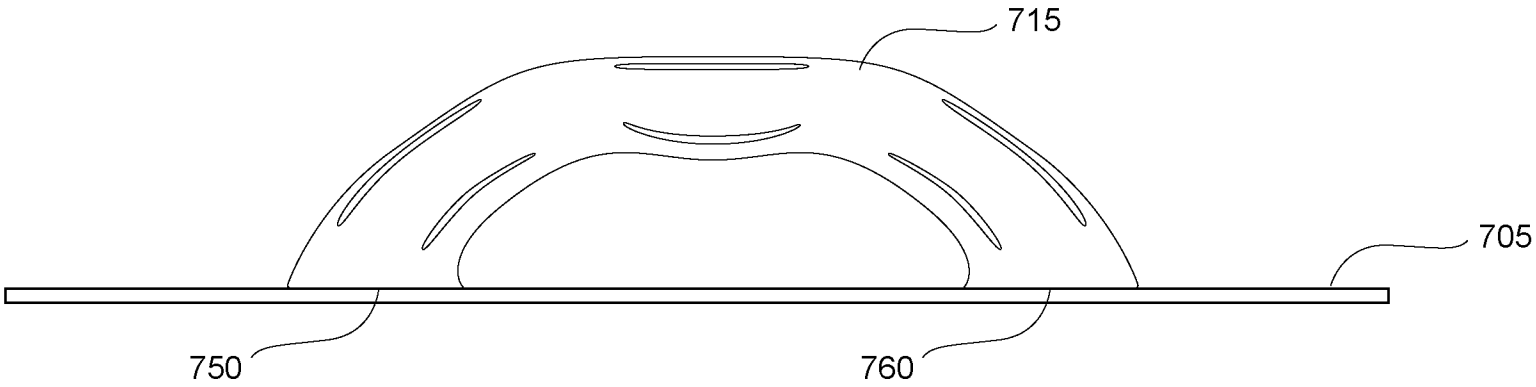
FIG. 7 illustrates a side view of the blade and a handle for a third type of trowel, according to at least one embodiment of the invention.

FIG. 7 illustrates a side view of the blade 705 and a handle 715 for a third trowel, according to at least one embodiment of the invention. In this embodiment, the handle 715 is of a different design having two separate attachment points 750 and 760. The handle 715 may be made of, for example, wood, metal, plastic, rubber, etc. and may be attached to the blade 705 using, for example, screws, molding, adhesive, welding, brazing, etc. The blade 705 may be made of the materials described herein, may have the shape and design as described elsewhere herein, and may be heat treated according to the methods described elsewhere herein.

Figure 8:
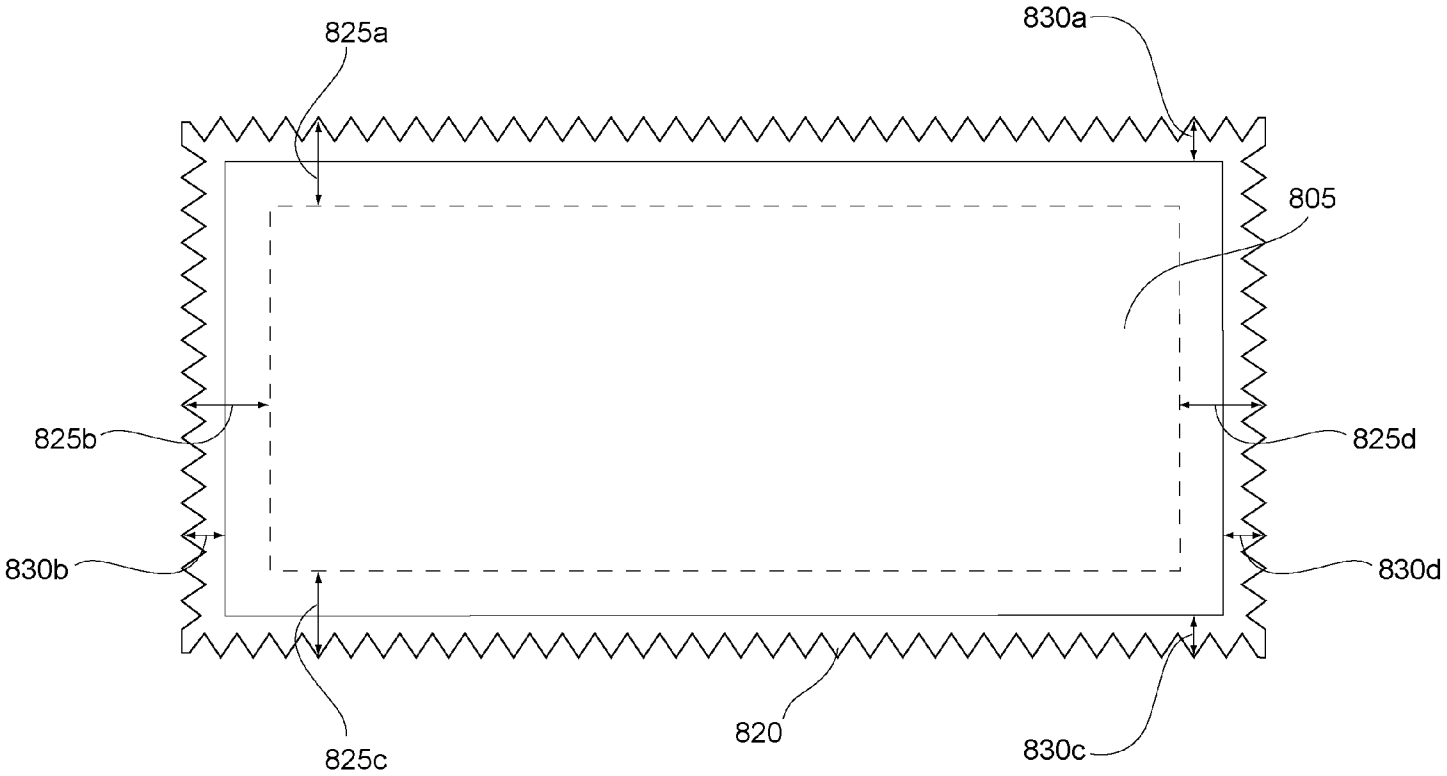
FIG. 8 illustrates the blade of another tool, according to at least one embodiments of the invention.

Referring to FIG. 8, a top view (without the handle and/or tang) of another texturing trowel blade 805 is provided. This texturing trowel blade may be couple to one of a number of handle designs (not shown attached thereto). The trowel blade 805 made of a material, for example, a metal. The metal may be, for example, a high carbon steel ranging between AISI 1060 steel and AISI 1095 steel. In this example, all four texturing edges, a, b, c, and d, may be in the shape of, for example, a V notch or teeth 820. Further, the V notch or teeth 820 may be partially heat treated as shown by, for example, distance 830*a*, a distance more or less than distance 830*a*, or completely heat treated, similar to the embodiments shown and described above. In this case, the heat treatment 830*a*, 830*b*, 830*c* and 830*d* are shown along each of the four sides or edges (a, b, c and d) of the trowel blade 805, side a. However, it is understood that the heat treatment may be applied to any and all of these or other areas of the trowel blade 805. The heat treatment may be performed using, for example, the process described with respect to FIG. 4 or a similar process for hardening the blade 805 material so that it is more durable, strong, and long lasting. As such, the blade 805 may be cleaned along one or more sides to be heat treated as indicated shown by the dotted line area, for example areas 825*a*, 825*b*, 825*c* and/or 825*d*, etc., prior to being heat treated.

Figure 9:
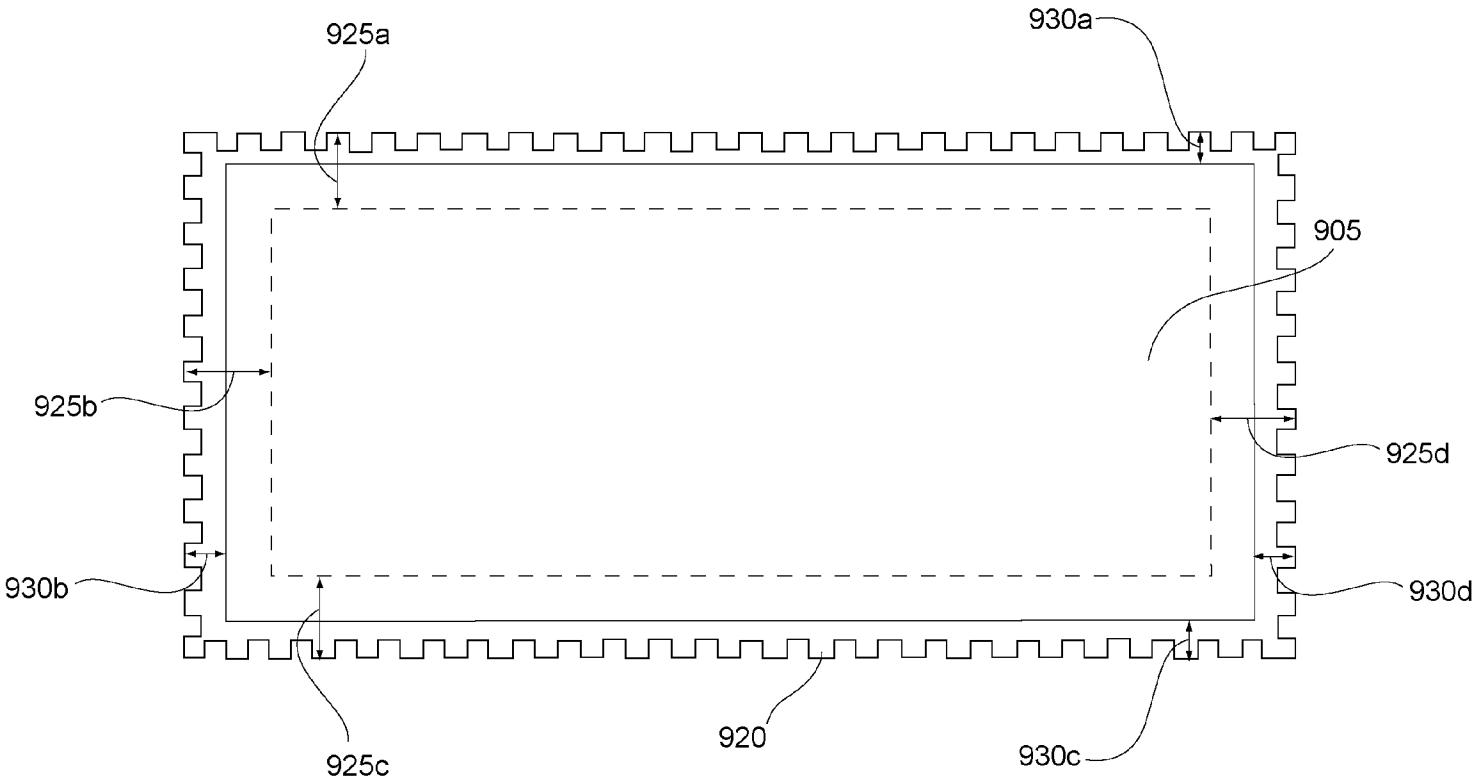
FIG. 9 illustrates the blade of another tool, according to at least one embodiments of the invention.

Referring to FIG. 9, a top view (without the handle and/or tang) of another texturing trowel blade 905 is provided. This texturing trowel blade may be couple to one of a number of handle designs (not shown attached thereto). The trowel blade 905 made of a material, for example, a metal. The metal may be, for example, a high carbon steel such as AISI 1060 steel or AISI 1095 steel, to name a few. In this example, all four texturing edges, a, b, c, and d, may be in the shape of, for example, a square notch or teeth 920. Of course a rectangular shape may also be used. Further, the square notch or teeth 920 may be partially heat treated as shown by, for example, distance 930*a*, a distance more or less than distance 930*a*, or completely heat treated, similar to the embodiments shown and described above. In this case, the heat treatment 930*a*, 930*b*, 930*c* and 930*d* are shown along each of the four sides or edges (a, b, c and d) of the trowel blade 905. However, it is understood that the heat treatment may be applied to any and all of these or other areas of the trowel blade 905. The heat treatment may be performed using, for example, the process described with respect to FIG. 4 or a similar process for hardening the blade 905 material so that it is more durable, strong, and long lasting. As such, the blade 905 may be cleaned along one or more sides to be heat treated as indicated shown by the dotted line area, for example areas 925*a*, 925*b*, 925*c* and/or 925*d*, etc., prior to being heat treated.

Figure 10:
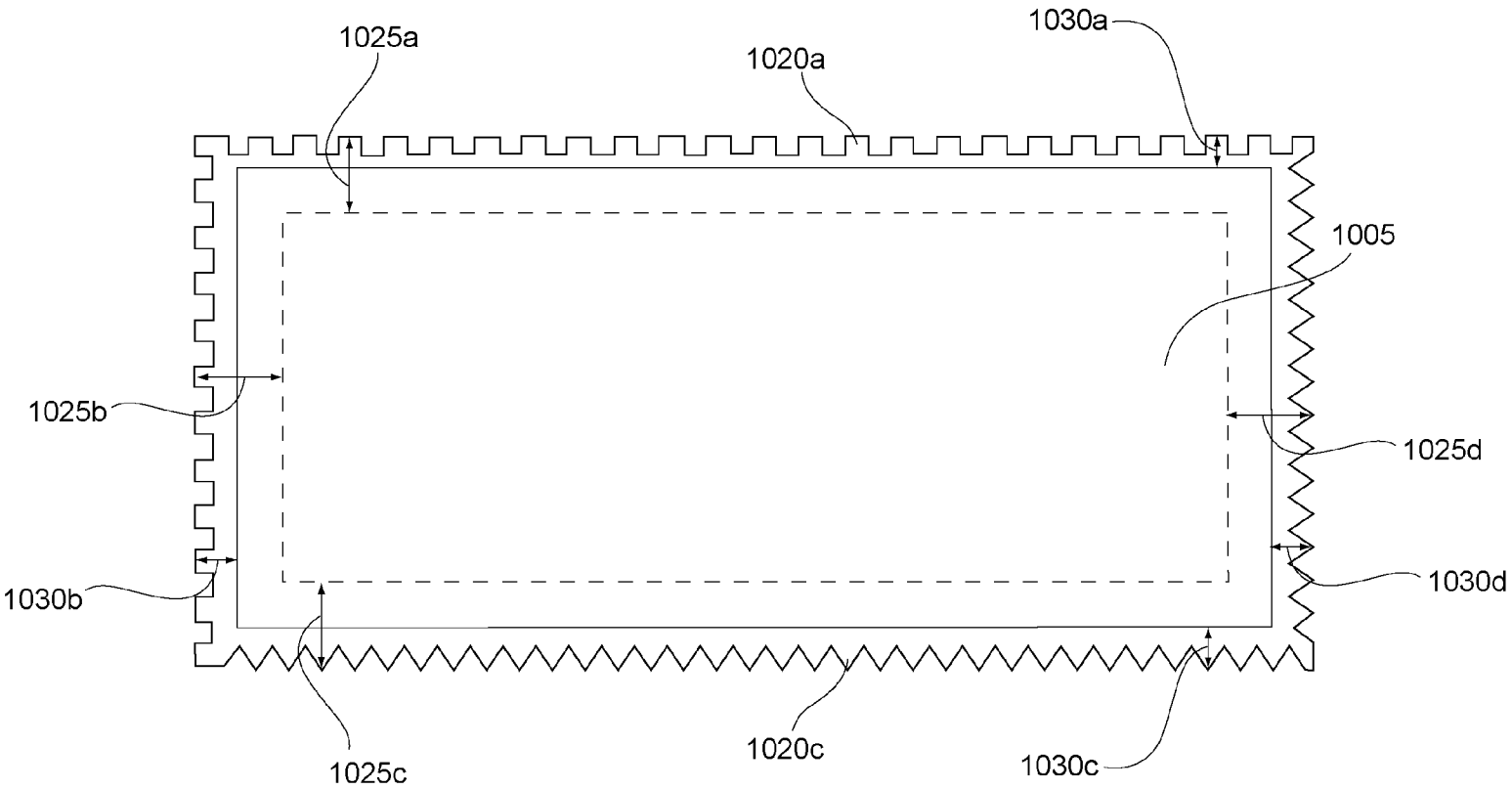
FIG. 10 illustrates the blade of another tool, according to at least one embodiments of the invention.

Referring to FIG. 10, a top view (without the handle and/or tang) of another texturing trowel blade 1005 is provided. This texturing trowel blade may be couple to one of a number of handle designs (not shown attached thereto). The trowel blade 1005 made of a material, for example, a metal. The metal may be, for example, a high carbon steel such as AISI 1060 steel or AISI 1095 steel, to name a few. In this example, all four texturing edges, a, b, c, and d, may be in the shape of, for example, a square notch or teeth 1020*a* and 1020*b* and a V notch or teeth 1020*c* and 1020*d*. Of course a rectangular shape may also be used. Further, the square notch or teeth 1020*a* and 1020*b* and/or the V notch or teeth 1020*c* and 1020*d*, may be partially heat treated as shown by, for example, distances 1030*a*, 1030*b*, 1030*c*, or 1030*d*, or a distance more or less than distance any of these distances, or completely heat treated, similar to the various embodiments shown and described above. In this case, the heat treatment area(s) 1030*a*, 1030*b*, 1030*c* and 1030*d* are shown along each of the four sides or edges (a, b, c and d) of the trowel blade 1005, side a. However, it is understood that the heat treatment may be applied to any and all of these or other areas of the trowel blade 1005. The heat treatment may be performed using, for example, the process described with respect to FIG. 4 or a similar process for hardening the blade 1005 material so that it is more durable, strong, and long lasting. As such, the blade 1005 may be cleaned along one or more sides to be heat treated as indicated shown by the dotted line area, for example areas 1025*a*, 1025*b*, 1025*c* and/or 1025*d*, etc., prior to being heat treated.

Figure 11:
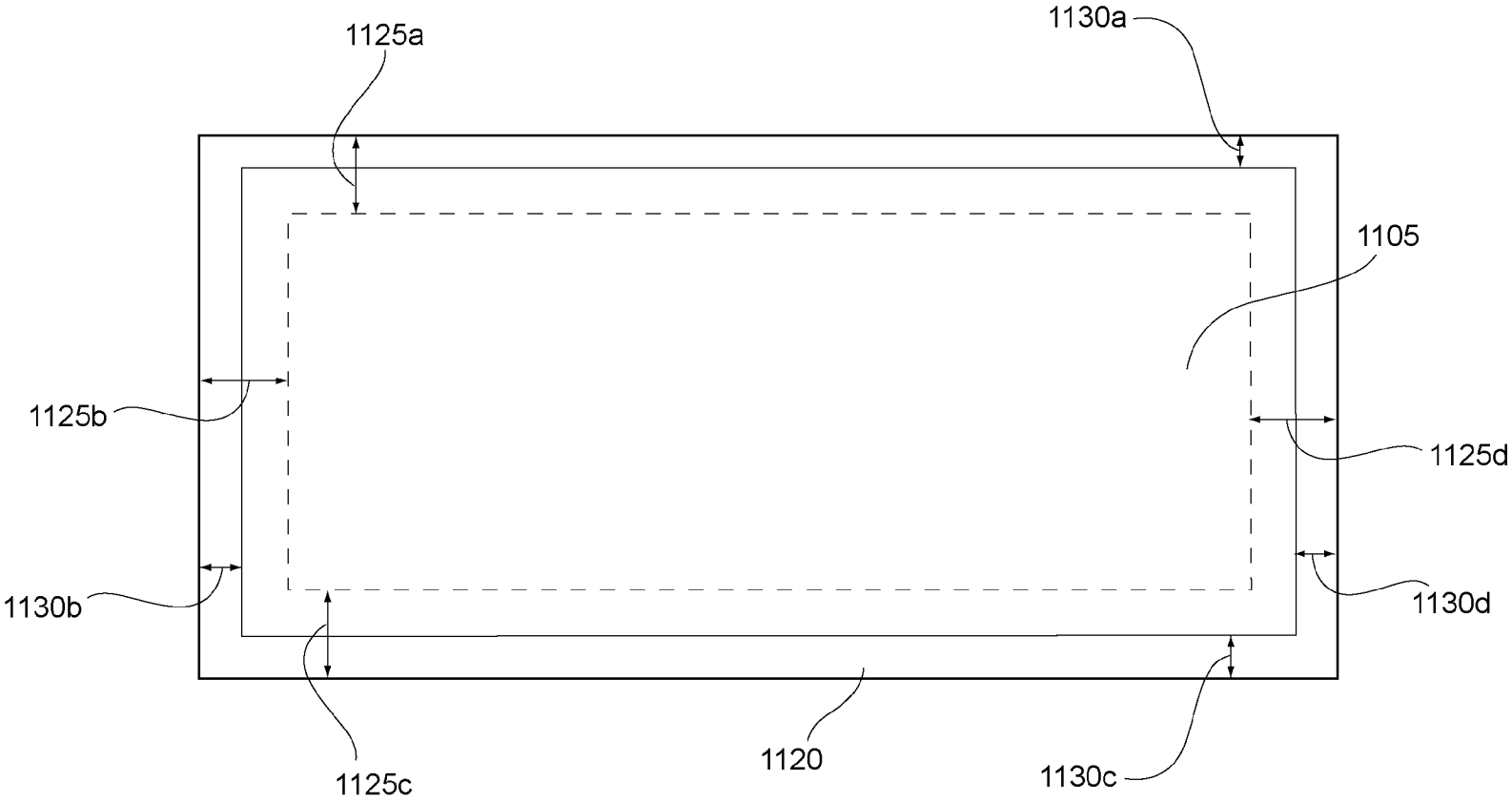
FIG. 11 illustrates the blade of another tool, according to at least one embodiments of the invention.

Referring to FIG. 11, a top view (without the handle and/or tang) of another trowel blade 1105 is provided. This trowel blade 1105 is for a straight edge trowel and that does not typically texture a working surface. Rather, it is meant for smoothing surfaces. However, its straight edges may be heat treated to make them last longer with extensive use on, for example, abrasive work surfaces, and be more durable if dropped so that the straight edge remains straight longer. In any case, the blade 1105 may be couple to one of a number of handle designs (not shown attached thereto). The trowel blade 1105 made of a material, for example, a metal. The metal may be, for example, a high carbon steel such as AISI 1060 steel or AISI 1095 steel, to name a few. In this example, all four of the edges, a, b, c, and d, may be straight and a portion thereof heat treated, as shown by solid lines with a distance of 1130*a*, 1130*b*, 1130*c*, and/or 1130*d*. One or more of these edges may be partially heat treated as shown by, for example, distance 1130*a*, a distance more or less than distance 1130*a*, or completely heat treated, similar to the embodiments shown and described above. In this case, the heat treatment area(s) 1130*a*, 1130*b*, 1130*c* and 1130*d* are shown along each of the four sides or edges (a, b, c and d) of the trowel blade 1105. However, it is understood that the heat treatment may be applied to any and all of these or other areas of the trowel blade 1105, as desired. The heat treatment may be performed using, for example, the process described with respect to FIG.

4 or a similar process for hardening the blade 1105 material so that it is more durable, strong, and long lasting. As such, the blade 1105 may be cleaned along one or more sides to be heat treated as indicated shown by the dotted line area, for example areas 1125*a*, 1125*b*, 1125*c* and/or 1125*d*, etc., prior to being heat treated.

Figure 12:
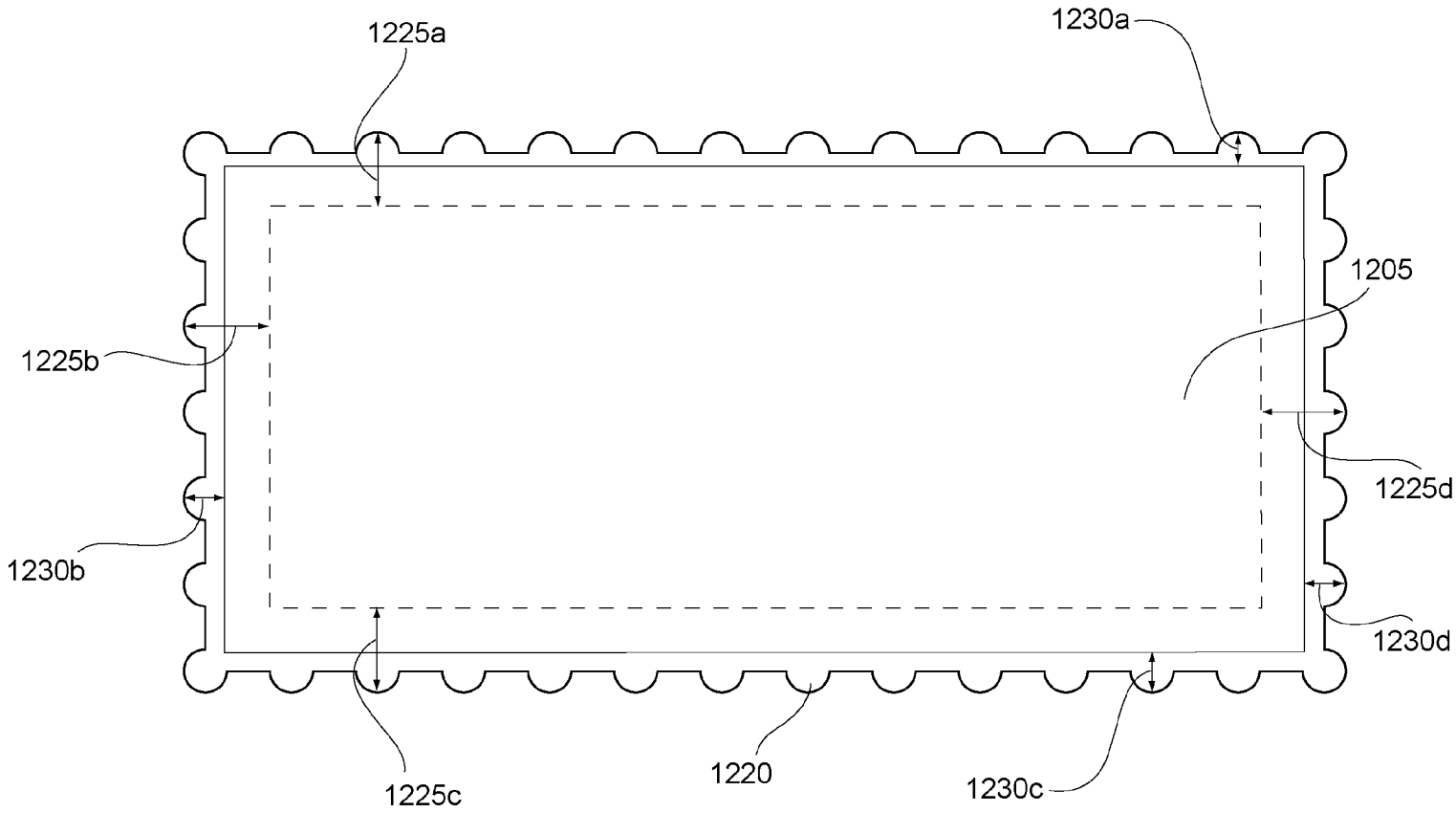
FIG. 12 illustrates the blade of another tool, according to at least one embodiments of the invention.

Referring to FIG. 12, a top view (without the handle and/or tang) of another texturing trowel blade 905 is provided. This texturing trowel blade may be couple to one of a number of handle designs (not shown attached thereto). The trowel blade 1205 made of a material, for example, a metal. The metal may be, for example, a high carbon steel such as AISI 1060 steel or AISI 1095 steel, to name a few. In this example, all four texturing edges, a, b, c, and d, may be in the shape of, for example, a square notch and rounded teeth 1220. Of course a rounded shape notch may also be used. Further, the square notch and rounded teeth 1220 may be partially heat treated as shown by, for example, distance 1230*a*, a distance more or less than distance 1230*a*, or completely heat treated, similar to the embodiments shown and described above. In this case, the heat treatment 1230*a*, 1230*b*, 1230*c* and 1230*d* are shown along each of the four sides or edges (a, b, c and d) of the trowel blade 1205. However, it is understood that the heat treatment may be applied to any and all of these or other areas of the trowel blade 1205. The heat treatment may be performed using, for example, the process described with respect to FIG. 4 or a similar process for hardening the blade 1205 material so that it is more durable, strong, and long lasting. As such, the blade 1205 may be cleaned along one or more sides to be heat treated as indicated shown by the dotted line area, for example areas 1225*a*, 1225*b*, 1225*c* and/or 1225*d*, etc., prior to being heat treated.

Figure 13:
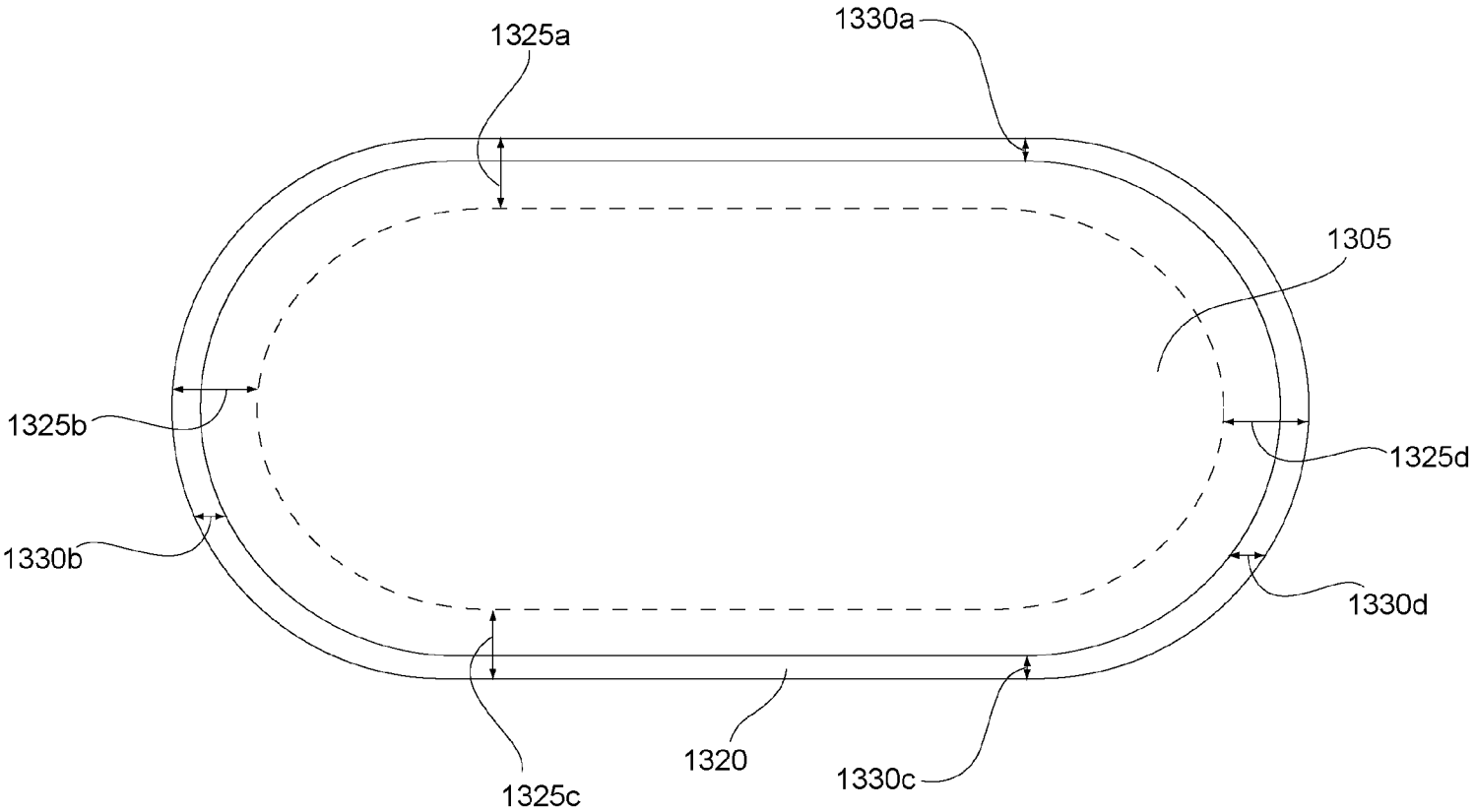
FIG. 13 illustrates the blade of another tool, according to at least one embodiments of the invention.

Referring to FIG. 13, a top view (without the handle and/or tang) of another trowel blade 1305 is provided. This trowel blade 1305 is for a swimming pool trowel having straight edge sides a and c and rounded sides b and d, that does not typically texture a working surface. Rather, it is meant for producing smooth surfaces in, for example, a swimming pool. However, its straight edges (a and c) and rounded edges (b and d) may be heat treated to make them last longer with extensive use on, for example, abrasive work surfaces such as cement, and be more durable if dropped so that the straight edges (a and c) and rounded edges (b and d) remains straight longer. In any case, the blade 1305 may be couple to one of a number of handle designs (not shown attached thereto). The trowel blade 1305 made of a material, for example, a metal. The metal may be, for example, a high carbon steel such as AISI 1060 steel or AISI 1095 steel, to name a few. In this example, all four of the edges, a, b, c, and d, may be straight and a portion thereof heat treated, as shown by solid lines with a distance of 1330*a*, 1330*b*, 1330*c*, and/or 1330*d*. One or more of these edges may be partially heat treated as shown by, for example, distance 1330*a*, a distance more or less than distance 1330*a*, or completely heat treated, similar to the embodiments shown and described above. In this case, the heat treatment area(s) 1330*a*, 1330*b*, 1330*c* and 1330*d* are shown along each of the four sides or edges (a, b, c and d) of the trowel blade 1305. However, it is understood that the heat treatment may be applied to any and all of these or other areas of the trowel blade 1305, as desired. In this case it may be particularly desirable to hear treat edges b and d since they are rounded. The heat treatment may be performed using, for example, the process described with respect to FIG. 4 or a similar process for hardening the blade 1305 material so that it is more durable, strong, and long lasting. As such, the blade 1305 may be cleaned along one or more sides to be heat treated as indicated shown by the dotted line area, for example areas 1325*a*, 1325*b*, 1325*c* and/or 1325*d*, etc., prior to being heat treated.

Figure 14:
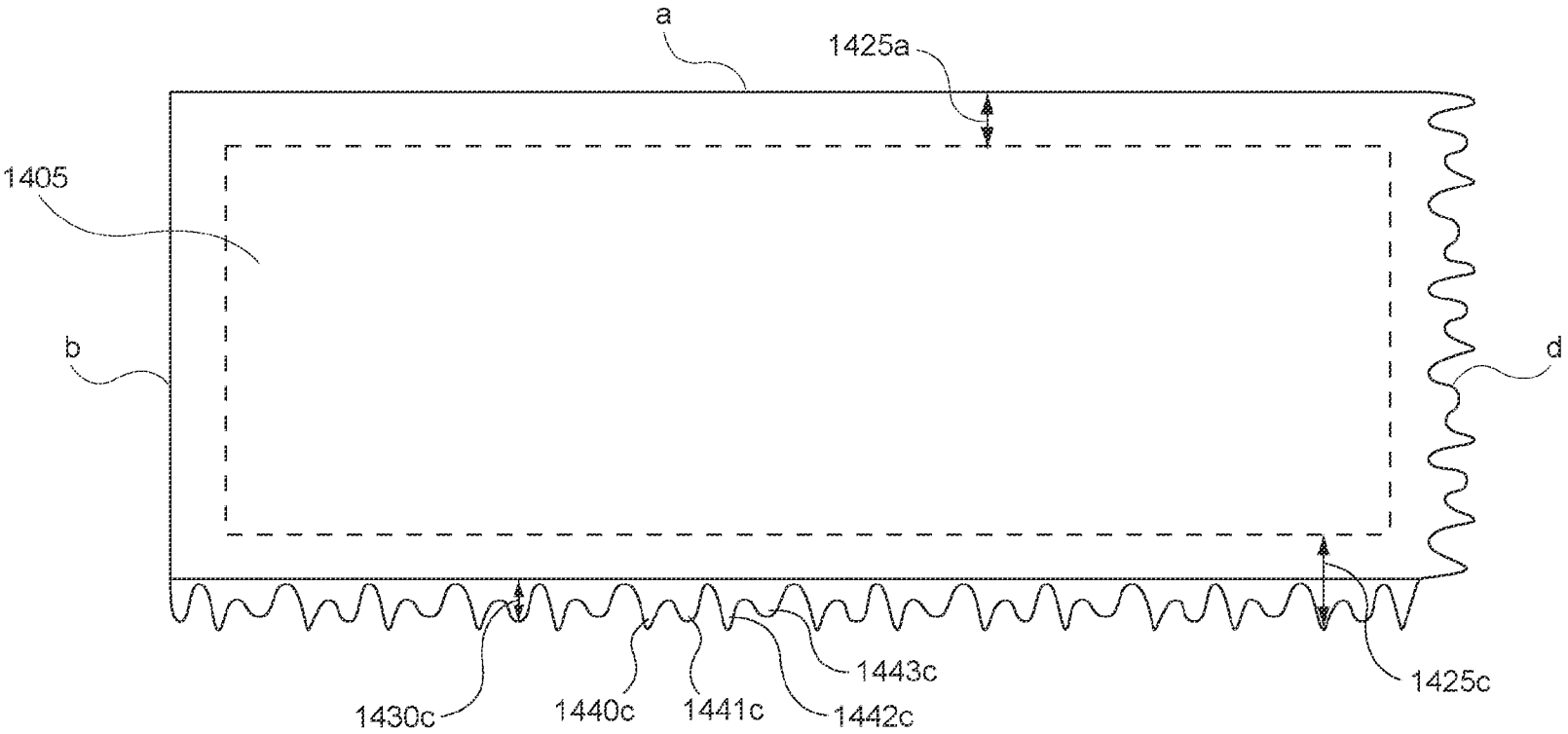
FIG. 14 illustrates the blade of another tool, according to at least one embodiments of the invention.

Referring to FIG. 14, a top view (without the handle and/or tang) of another trowel blade 1405 is provided. This trowel blade 1405 may be a muti-shaped tooth trowel having straight edge sides a and b and textured sides b and d. The textured sides b and d may have a plurality of different shaped teeth, 1440*c*, 1441*c*, 1442*c*, 1443*c*, that may texture a working surface. This texturing trowel 1405 may have a trowel blade 505 made of a material, for example, a metal. The metal may be, for example, a high carbon steel such as AISI 1060 steel or AISI 1095 steel to name a few. In this example, the texturing edge may be in the shape of, for example, a repeating pattern of teeth, for example, four different shaped teeth in series that repeat to form a complete side of texturing teeth, for example sides c and d. Of course the repeating pattern may be of 2, 3, 4, etc. number of teeth. Further, the muti-shaped notches or teeth along side c may be partially heat treated or completely heat treated as shown by distance 1430*c*. In this case, the heat treatment 1430*c* is shown along only one side or edge of the trowel blade 1405, side c. However, it is understood that the heat treatment may be applied to any and all areas of the trowel blade 1405. The heat treatment may be performed using, for example, any of the processes described above, or a similar process, for hardening the blade 1405 material so that it is more durable, strong, and long lasting. As such, the blade 1405 may be cleaned along one or more sides to be heat treated as indicated shown by the dotted line area, for example areas 1425*a* and/or 1425*c*, etc., prior to being heat treated. Although, it would be understood by one skilled in the art that the invention may be applicable to trowels with blades and teeth having any of a number of shapes and combination thereof. Now, various other types of exemplary building tool embodiments of the present invention will be provided.

Figure 15:
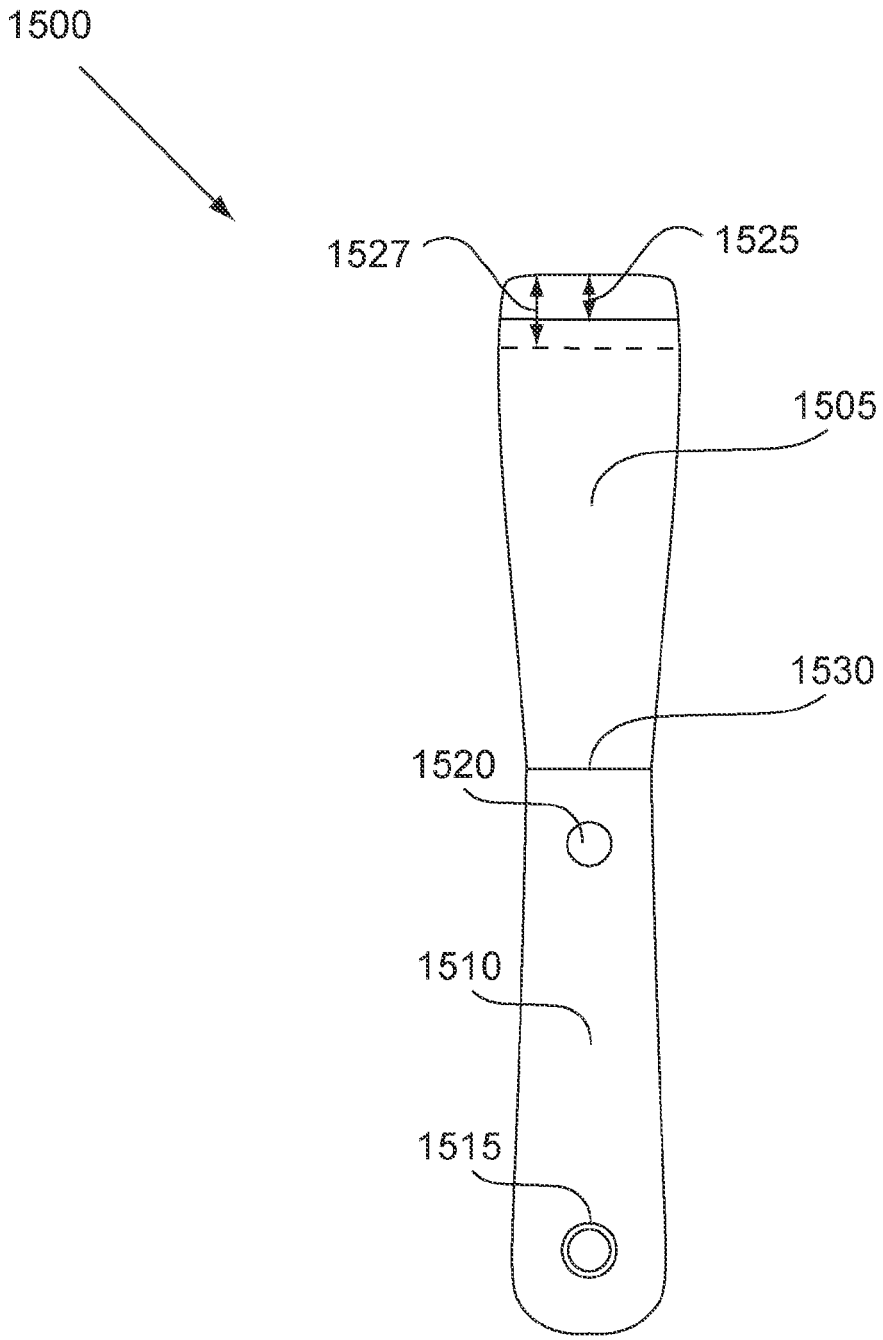
FIG. 15 illustrates another type of building tool, according to at least one embodiment of the invention.

Referring to FIG. 15, a side view of another building tool, a putty knife or spackle knife 1500 is provided. This exemplary putty knife 1500 is used in the building and construction trades and may include a blade 1505 that may be permanently attached or coupled to a handle 1510 using, for example, rivets 1515 (with a opening in the center) and 1520. The interface of the blade 1505 and the handle 1510 occur at line 1530, and may be where they are in close proximity to each other when viewed from the side, having the hand composed of two separate pieces on either side of the continuation of the blade 1505 extending the entire length of the putty knife 1500. In such a construction, the rivets 1515 and 1520 may be used to permanently secure the two handle sections (only one shown in this side view) together on either side of the flat elongated blade 1505 material. In one variation, the two handles may be permanently held together and to the blade using a two piece core and an over mold to hold the two pieces together (as shown in the next embodiment).

The putty knife handle 1510 may be made of one of numerous materials, for example, wood, cork, plastic, rubber, etc., that may be two hollow or solid pieces, or have a hole through the center to accommodate a means of attaching the handle 1510 to the blade 1505 in a permanent manner (e.g. welding, epoxy adhesive, etc.). The putty knife blade 1505 may be made of a material, for example, a metal. The metal may be, for example, a high carbon steel such as AISI 1060 steel or AISI 1095 steel, stainless steel, etc., to name a few. In this example, the primary working edge of the blade 1505 may have a portion thereof heat treated, as shown by solid line with a distance of 1525. In variations of this theme, other edges or the entire blade 1505 of the putty knife may also be heat treated if desired. However, heat treating the entire blade

1505 may make the entire length of the flattened blade section more brittle and more subject to cracking or breaking at, for example, the area around the handle-to-blade interface 1530. As such, it is preferable that at least the working edge may be partially heat treated as shown by, for example, distance 1525, or a distance more or less than distance 1525, rather than completely heat treated, similar to the various embodiments shown and described above. In this case, the heat treatment area 1525 is shown only along one of the edges of the putty knife blade 1505. The heat treatment may be performed using, for example, the process described with respect to FIG. 4 or a similar process for hardening the blade 1505 material so that at least the working edge is more durable, strong, and long lasting. As such, the blade 1505 may be cleaned along one or more sides to be heat treated as indicated shown by the dotted line area, for example area 1527, prior to being heat treated. As noted above relative to other embodiments, one skilled in the art will appreciate that the present invention as embodied in the putty knife building construction tool, is made of a non-disposable blade construction preferably having the blade 1505 securely mounted to a handle 1510 and/or a handle connecting mechanism (e.g., rivets 1515 and 1520, or structure welded to the blade and inserted into the handle) and the putty knife will last longer and will not need to be thrown away or have the heat treated working edge 1525 of the blade 1505 reworked by, for example, manual or machine sharpening (i.e., not simply replacing the blade) as often. Therefore, using the present invention, standard putty knife designs like shown in FIG. 15, that typically do not have quick replacement blade designs or constructions, last much longer before the working surface of the blade 1505 needs reworked of the entire putty knife 1500 is thrown away and a new putty knife 1500 is purchased to replace it.

Figure 16A:
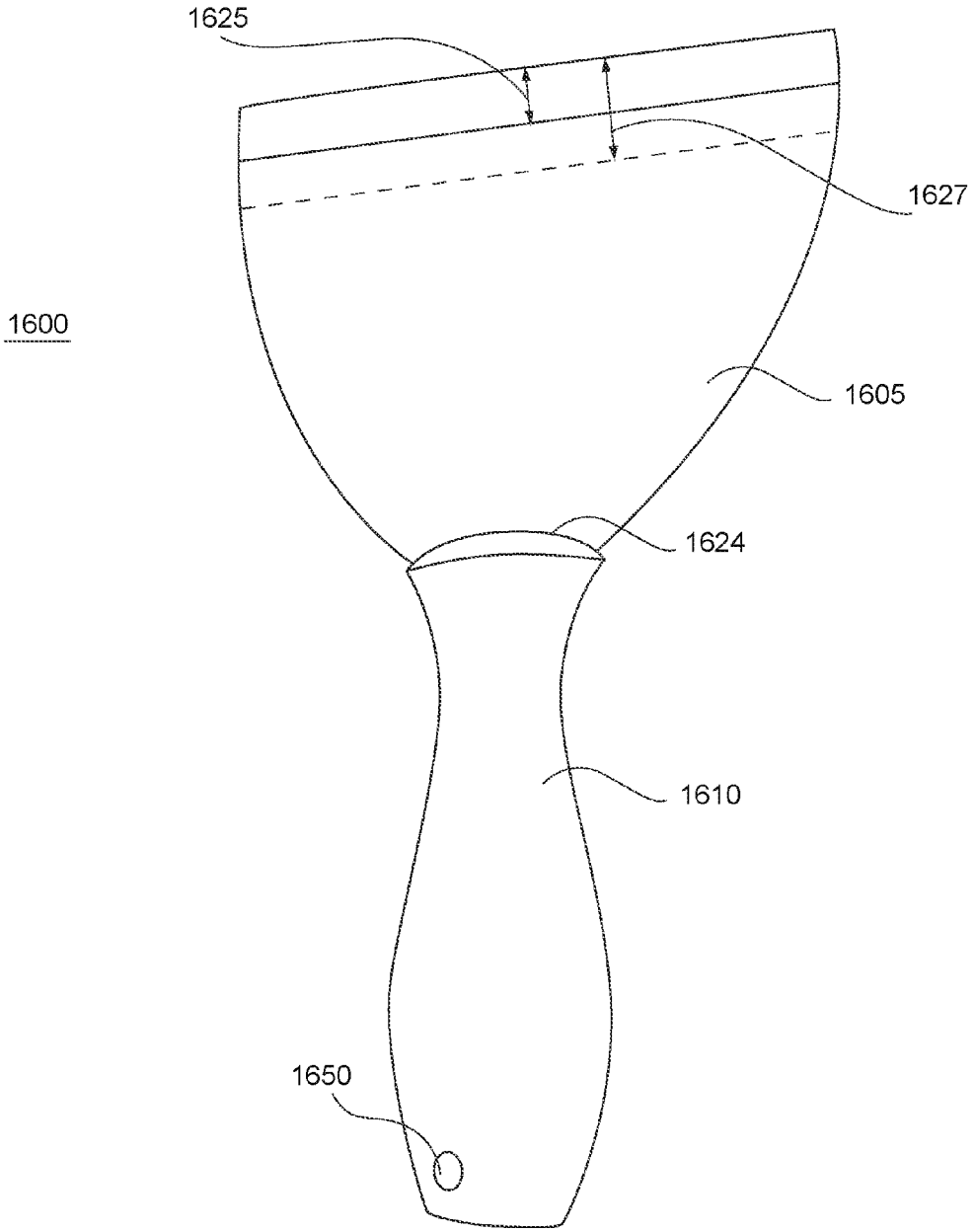
FIGS. 16A-16G illustrate another type of building tool, according to at least one embodiment of the invention.

Referring to FIGS. 16A-16G, a more detailed description of a molded over handle putty knife or spackle knife 1600 having a wider blade is provided. In FIG. 16A, a perspective view of the putty knife or spackle knife 1600 is provided. This exemplary putty knife 1600 is typical of those used in the building and construction trades and may include a blade 1605 that may be permanently attached or coupled to a handle 1610 using, for example, a handle comprised of a two sectioned internal handle structure made of plastic (placed on either side of at least a part of the elongated flat blade structure) and a rubber over mold holding that hold the two sectioned handle structure to each other and the blade 1605. Alternatively, the handle 1610 could permanently attached to the blade 1605 using two rivets. The interface of the blade 1605 and the handle 1610 occur at area 1624. In any case, the over molded handle 1610 may be composed of three separate pieces on either side of the continuation of the blade 1605 extending the entire length of the putty knife 1600, or almost the entire length with an end cap on its far end. In such a construction, the three component handle structure with rubber over mold may be used to permanently secure the two plastic handle sections (together on either side of the flat elongated blade 1605 material.

The putty knife blade 1605 may be made of a material, for example, a metal. The metal may be, for example, a high carbon steel such as AISI 1060 steel or AISI 1095 steel, to name a few. In this example, the primary working edge of the blade 1605 may have a portion thereof heat treated, as shown by solid line with a distance of 1625. In variations of this theme, other edges or the entire blade 1605 of the putty knife may also be heat treated if desired. However, heat treating the entire blade 1605 may make the entire length of the flattened blade section more brittle and more subject the cracking or breaking at, for example, the area around the handle-to-blade interface 1624 or where a handle-to blade attachment means would be permanently attached to the blade 1605 (one may consider the portion of the flat metal from the blade area 1605 extending into the handle 1610 as being a handle-to-blade attachment mechanism or tang, as it performs the same function even though made integral to the blade in this example). As such, it is preferable that at least the working edge may be partially heat treated as shown by, for example, distance 1625, or a distance more or less than distance 1625, rather than completely heat treated, similar to the various embodiments shown and described above. In this case, the heat treatment area 1625 is shown only along one of the edges of the putty knife blade 1605. The heat treatment may be performed using, for example, the process described with respect to FIG. 4 or a similar process for hardening the blade 1605 material so that at least the working edge is more durable, strong, and long lasting. As such, the blade 1605 may be cleaned along one or more sides to be heat treated as indicated shown by the dotted line area, for example area 1627, prior to being heat treated. As noted above relative to other embodiments, one skilled in the art will appreciate that the present invention as embodied in the putty knife or spackle knife building construction tool, is made of a non-disposable permanently attached blade construction preferably having the blade 1605 securely mounted to a handle 1610 and/or a handle connecting mechanism (not shown here) and the putty knife will last longer and will not need to be thrown away or have the heat treated working edge 1625 of the blade 1605 reworked by, for example, manual or machine sharpening (i.e., not simply replacing the blade) as often. Therefore, using the present invention, standard putty knife designs like shown in FIG. 16A, that typically do not have quick replacement blade designs or constructions, last much longer before the working surface of the blade 1605 needs reworked of the entire putty knife 1600 is thrown away and a new putty knife 1600 is purchased to replace it. It is noteworthy that if the blade 1605 is sufficiently wide, e.g., six inches or more, than this tool may be considered a taping knife rather than a putty knife or spackle knife.

Figure 16B:
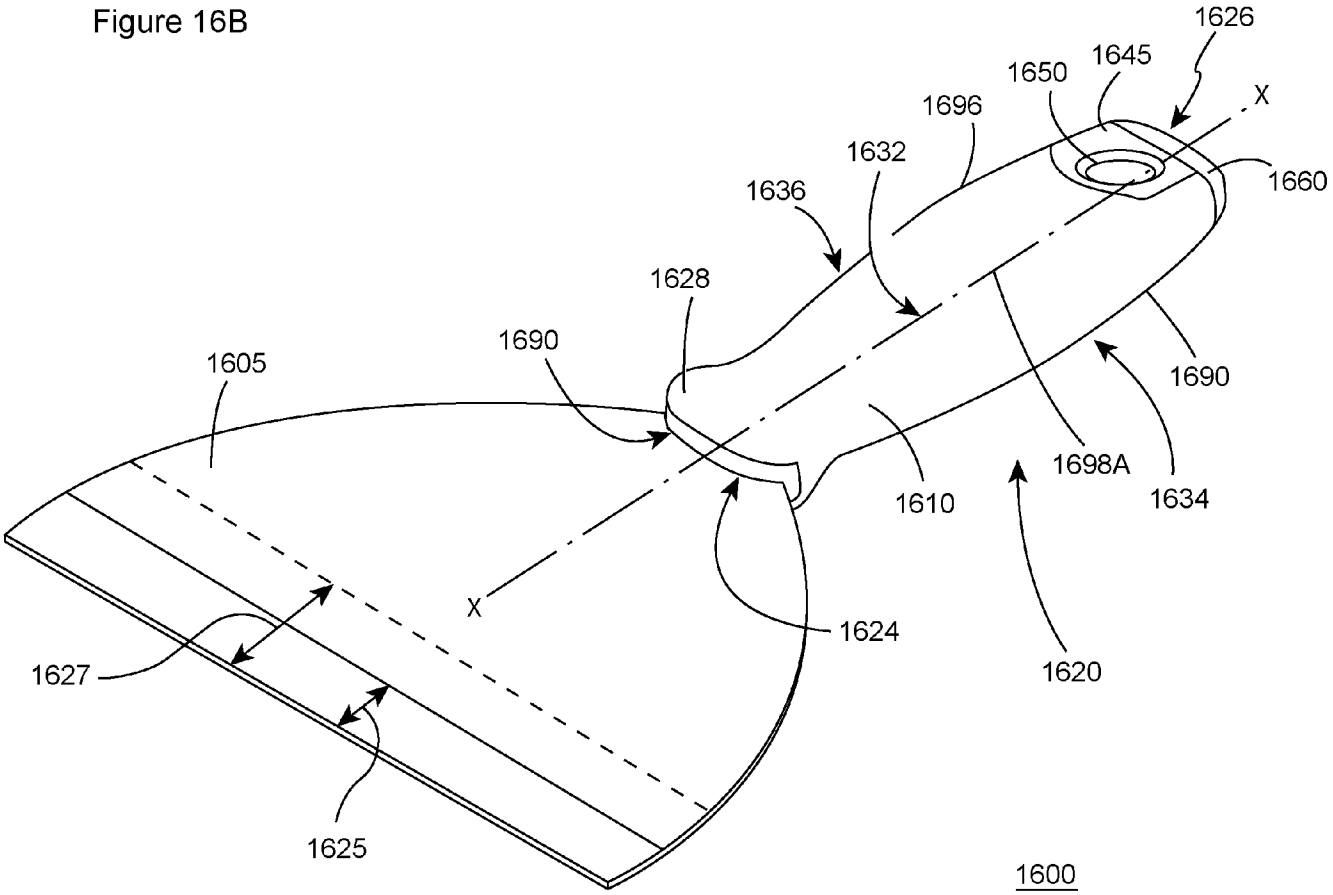

Referring to FIG. 16B, another variation of the invention with a perspective view is provided. In this figure, the putty knife 1600 includes a blade 1605 connected to a handles 1610. As with FIG. 16A, the putty knife 1600 handle 1610 may be comprised of three pieces, two opposing plastic pieces (e.g., 1690) that are on either side of the extended blade 1605 or handle-to-blade connection mechanism, and a rubber over mold 1628 that holds the two plastic portions together or simply surrounds them. In one variation the plastic portion may be made formed permanently around the blade 1605 using an injection molding process. Alternatively, the handle 1610 may be a single piece having an elongated hollow hole at it center wherein an extended portion of the blade 1605 is inserted or an injection molded single piece of plastic (e.g., 1690) that covers, surrounds, and holds to the handle 1610 to the extended blade portion. In the former case, an attachment means 1645 may be used to couple the blade 1605 to the handle 1610 and keep the blade 1605 from retracting from the handle 1610, and/or attaching an end cap 1660. The attachment means may be formed of, for example, metal or plastic, and may have a hole formed therein, appearing as an oversized and/or elongated rivet. Further, the putty knife 1600 may have an end cap 1660 that is securely coupled to the far end of the handle 1610. Again, in this embodiment, the primary working edge of the blade 1605 may have a portion thereof heat treated, as shown by solid line with a distance of 1625 and the blade 1605 may be cleaned along one or more sides to be heat treated as indicated shown by the dotted line area, for example area 1627, prior to being heat treated. Also, as noted above, the handle may be affixed to the blade in what would be considered by one skilled in the art as permanently, and does not use a disposable or replaceable blade design, but provides longer useful life by heat treatment of the blade, at least in part because the relatively high initial cost of the entire putty knife 1600 and its respective replacement cost. For a relatively small amount of cost related to the heat treatment of at least the working portion of the blade 1605, the life of the putty knife 1600 can be increased by approximately 3-4 times and the design is not complicate or made unnecessarily heavier by adding a removable blade feature.

Figure 16C:
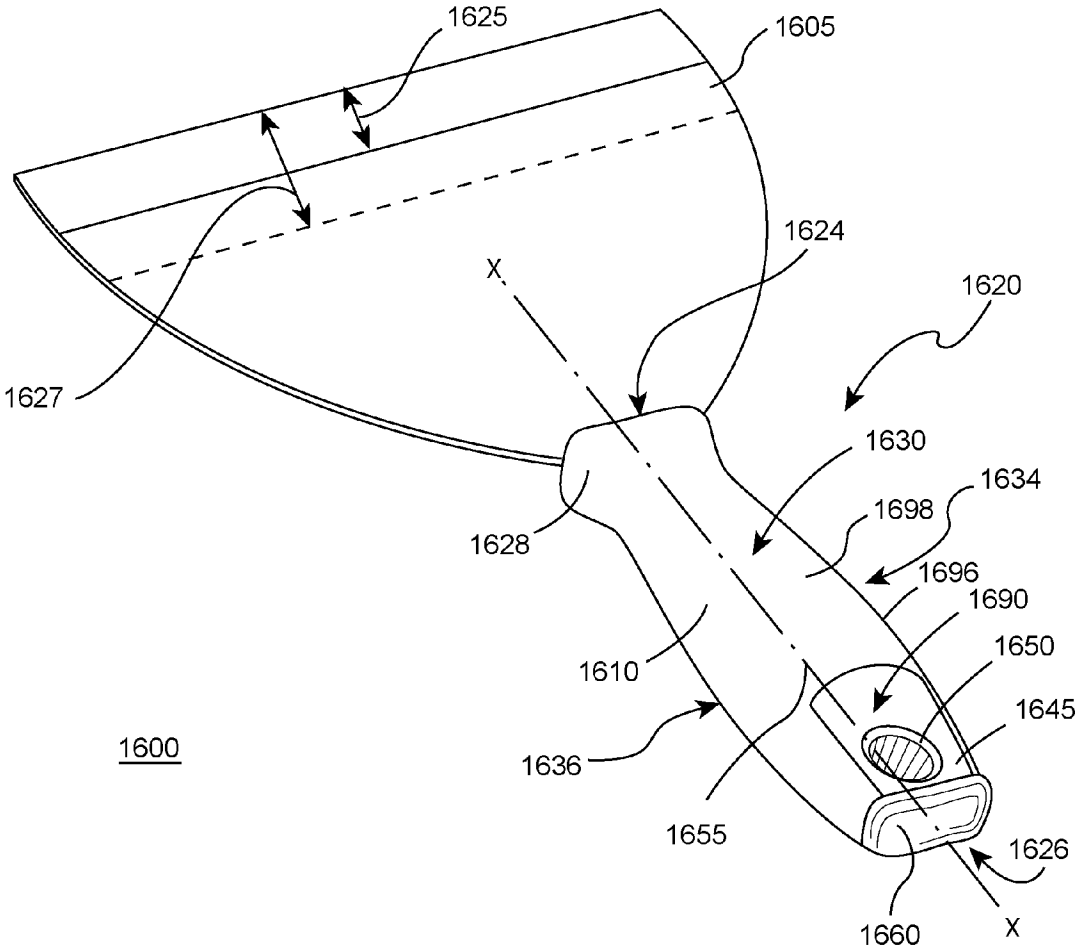

Referring to FIG. 16C, another perspective view of the putty knife or spackling knife 1600 is provided showing a better view of the end cap angle.

Figure 16D:
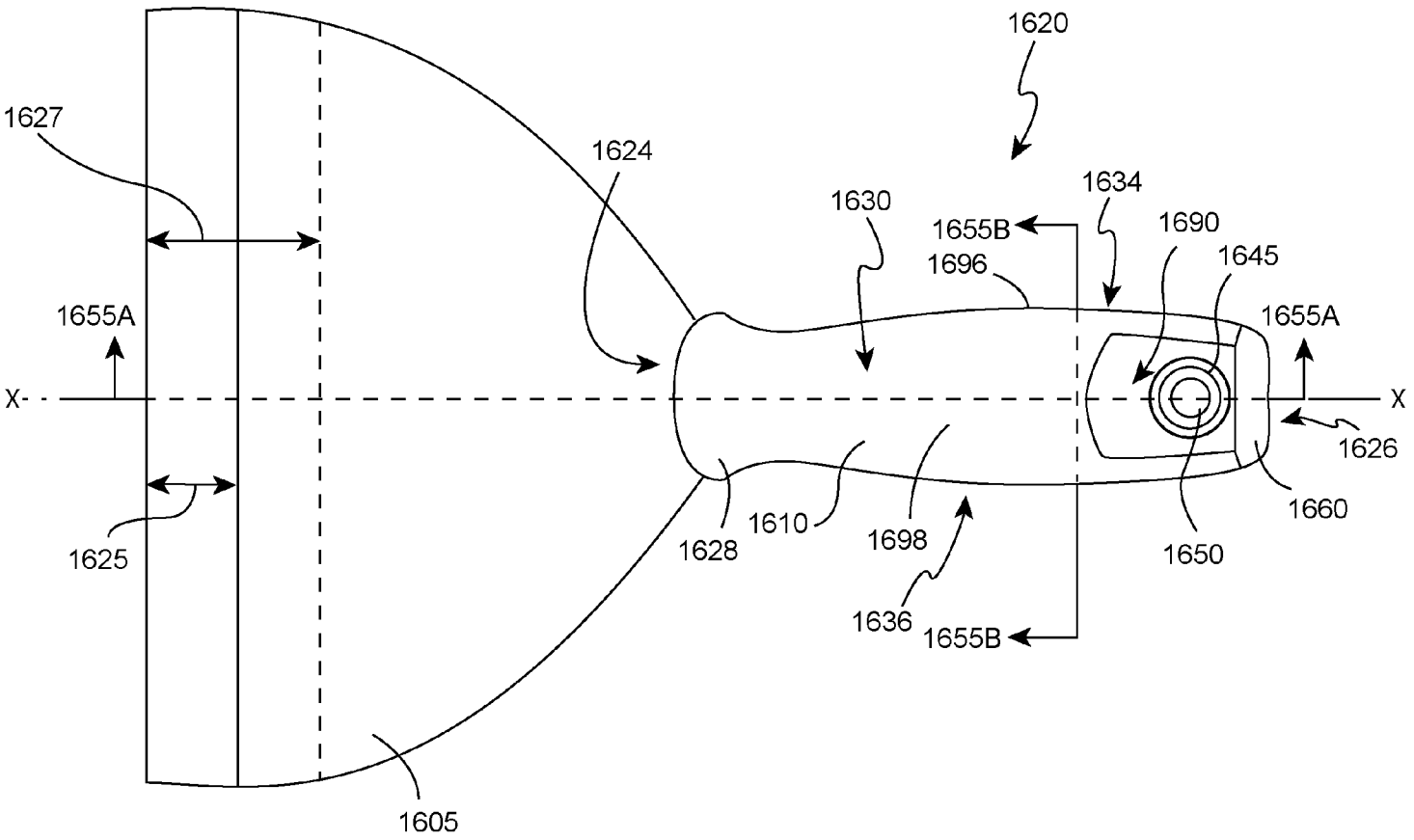

Referring to FIG. 16D, provides a side plan view of the putty knife 1600. From this view, one can appreciate the five or six main parts or areas of the putty knife 1600. The putty knife handle 1610 may be comprised of, for example, four main pieces, a central housing 1690 made of, for example, a molded plastic that surrounds the handle end of the blade 1605 or handle-to-blade connection mechanism (only a small portion of 1690 next to end cap 1660 shows in this view), an over mold section 1630 that may be made of, for example, a plastic or rubber, a rivet 1645 having a hole therein 1650, and an end cap 1660 that may be made of, for example, a durable plastic or a metal (so that it may be struck by a hammer or such). The blade 1605 once again, in this embodiment, includes the primary working edge of the blade 1605 that has a portion thereof heat treated, as shown by solid line with a distance of 1625 (and the blade 1605 may be cleaned along one or more sides to be heat treated as indicated shown by the dotted line area, for example area 1627, prior to being heat treated).

Figure 16E:
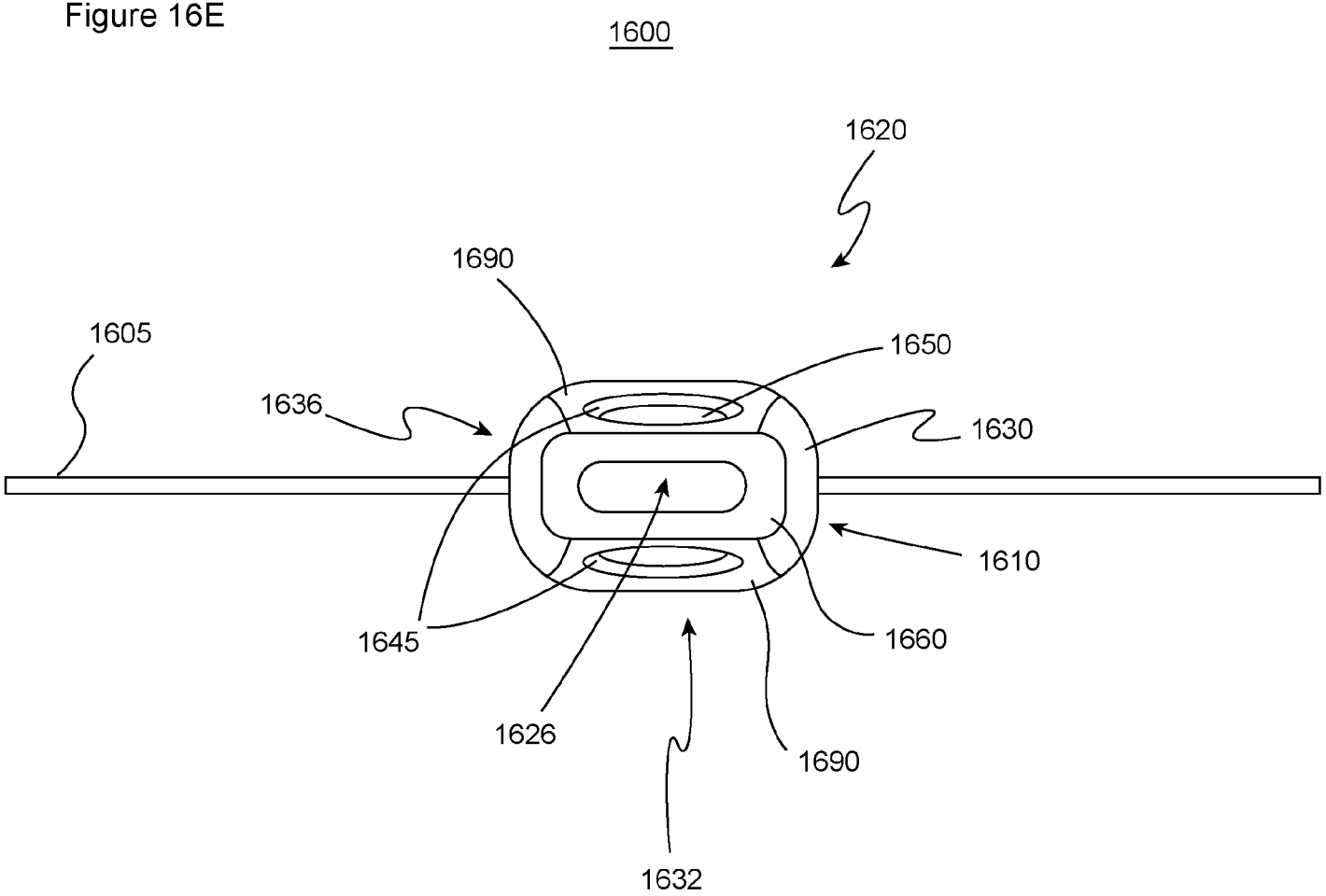

Referring to FIG. 16E, another plan view of the putty knife or spackling knife 1600 is provided showing a side view of the putty knife 1600 from the end cap 1660 side. The putty knife handle 1610 may be comprised of, for example, an inner or central housing 1690 that extends in part to the exterior surface of the handle 1610, and extends inward to surround the handle end of the blade 1605 or handle-to-blade connection mechanism (again, only a small portion of 1690 next to end cap 1660 shows in this view), an over mold section 1630 (to both the left and right), a rivet 1645 having a hole 1650 therein, and an end cap 1660 that may also have a hone or indent 1626 therein. Finally, the wider portions of the blade extend to the right and left of the handle portions. It is noteworthy from this view one can see that the putty knife is symmetrical about a center axis (see FIGS. 16B-16D also).

Figure 16F:
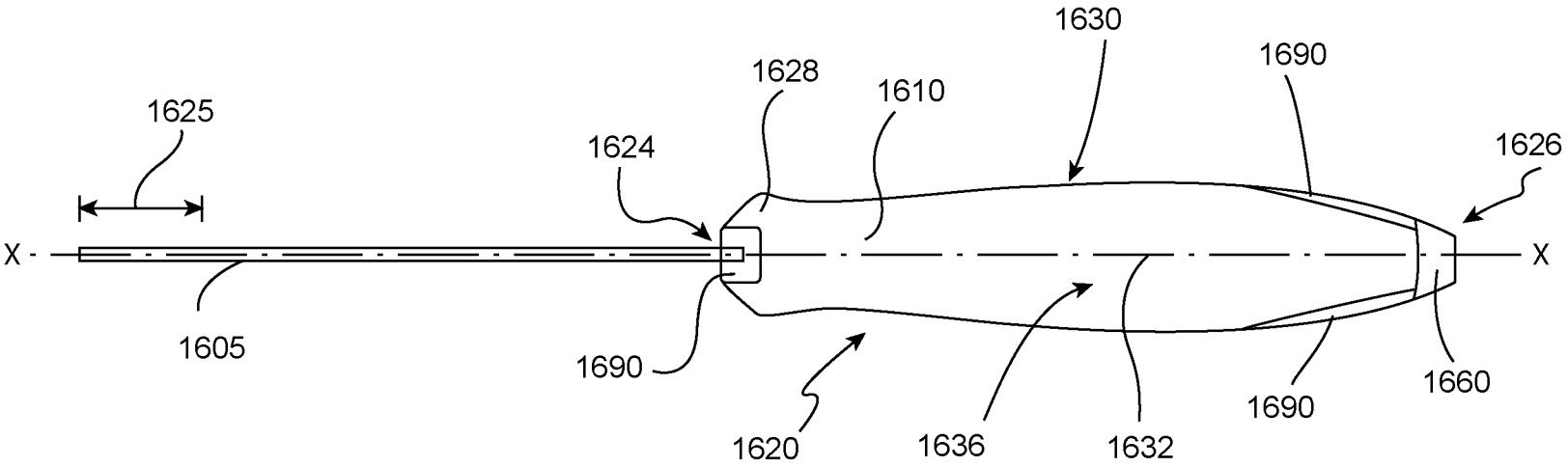

Referring to FIG. 16F, another plan view of the putty knife or spackling knife 1600 showing a side view of the putty knife 1600 from either the left or right side. It is noteworthy that from this perspective one can see the clearly at the inward side 1624 of the handle 1610 that the inner or central housing portion 1690 is covered by the over mold portion 1628. Further, the putty knife 1600 from this perspective is also symmetrical about center line XX (1632).

Figure 16G:
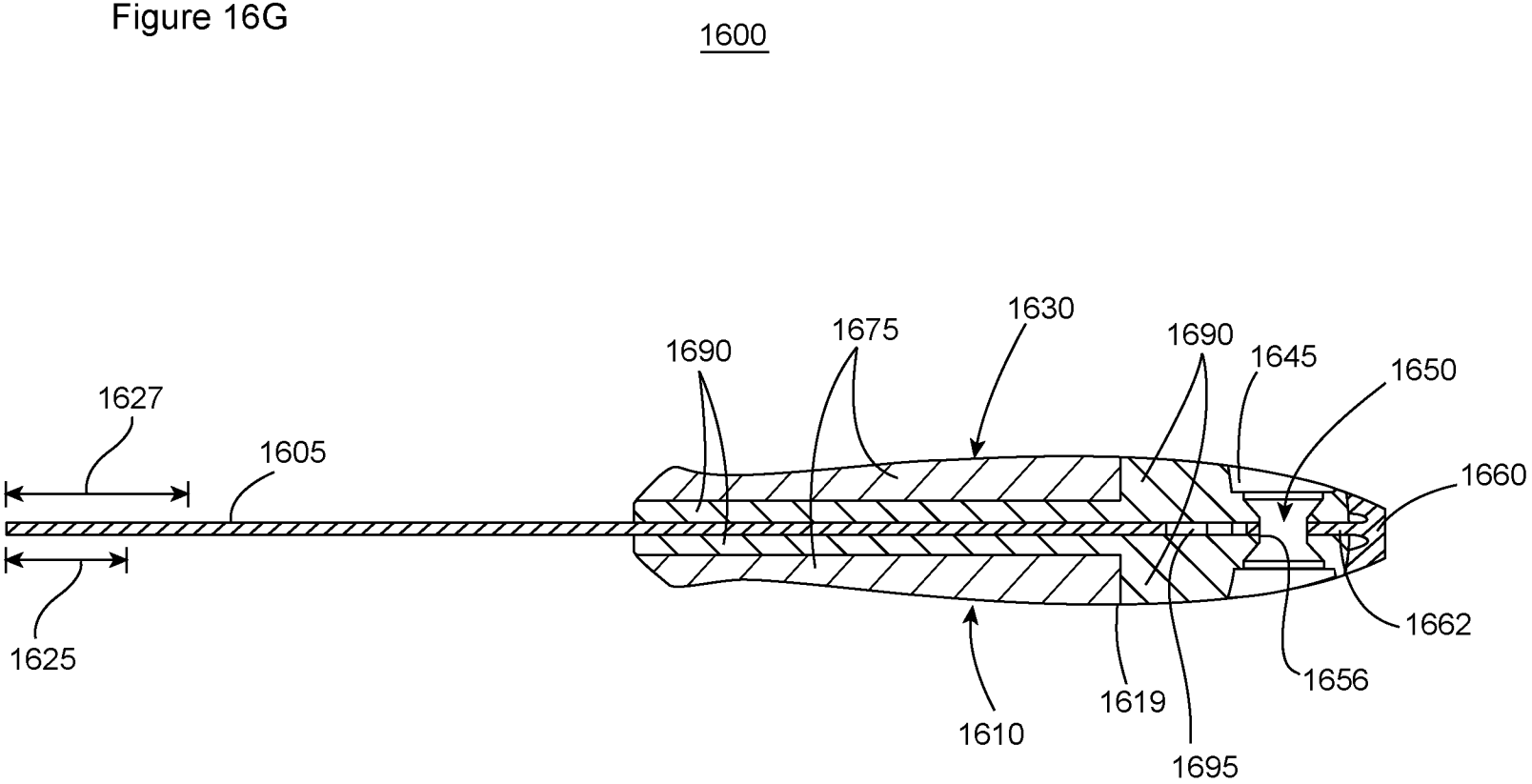

Referring to FIG. 16G, a cross-section view of the putty knife or spackling knife 1600 is provided as taken along line 1655A as shown in FIG. 16D. From this view, one can most clearly see that the elongate blade portion 1605 that extends through the handle portion 1610 is almost entirely covered by the inner or central housing portion 1690, which is locked therewith by in-part the material of 1690 being channeled through a hole 1695 in the end of the blade 1605 covered by the inner or central housing portion 1690. The handle may also be secured to the blade 1605 or the handle-to blade connecting mechanism by the rivet 1645 and/or the end cap 1660 may be coupled to the handle 1610 by the rivet 1645 (note portions 1662 and 1656 of the end cap 1600 surrounding the through hole area 1650 of the rivet 1645). As can be seen from this view also, the majority of the inner or central housing portion 1690 may be covered by the over mold section 1630 from the blade 1605 connection entry side of the handle 1610 up corner or ridge 1619. The blade 1605 once again, in this embodiment, includes the primary working edge of the blade 1605 that has a portion thereof heat treated, as shown by solid line with a distance of 1625 (and the blade 1605 may be cleaned along one or more sides to be heat treated as indicated shown by the dotted line area, for example area 1627, prior to being heat treated). Once again, the putty knife 1600 from this perspective is also symmetrical about center line XX (1632).

Figure 17:
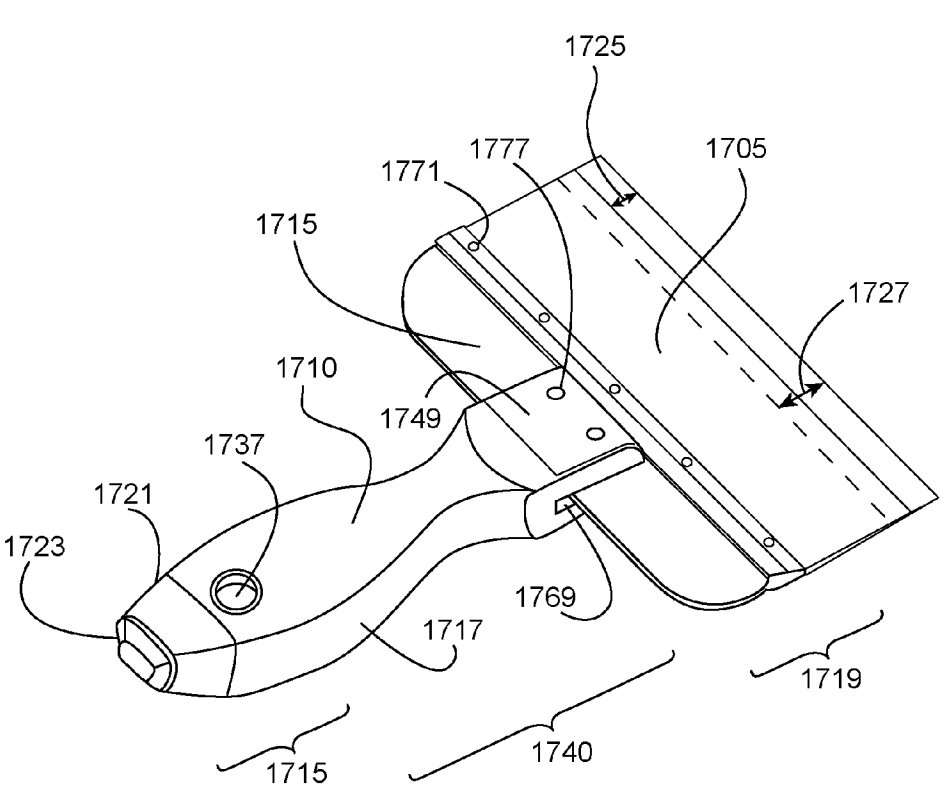
FIG. 17 illustrates another type of building tool, according to at least one embodiment of the invention.

Referring to FIG. 17, a perspective view of another building tool, a taping knife or joint knife 1700 is provided. Taping knifes are made with particularly wide (e.g., 6-10 inch or more blades) and flexible blades for applying, for example, plaster or mastic material to tape that is used to cover, for example, joints between drywall boards in interior room wall and ceiling structures. Ideally, the blades of the are made of a flexible metal such as stainless steel or a high carbon steel such as AISI 1060 steel or AISI 1095 steel, to name a few. This exemplary taping knife 1700 is used in the building and construction trades and may include a blade 1705 that may be permanently attached or coupled to a handle 1710 using, for example, rivets 1771 and 1777, or an adhesive, welding, or brazing the respective parts together. The blade 1705 and the handle 1710 may be coupled together with a handle-to-blade mechanism 1715, that may be made of, for example, a plastic or a metal such as aluminum. The handle-to-blade mechanism 1715 may be attached to the handle via a grove 1769 in a proximal end of the handle 1710, and the blade 1705 may be couple to the mechanism 1715 via an elongated groove along the mechanism 1715. The handle 1710 may be made of such materials as wood, cork, plastic, molded rubber over one of these materials, light weight metals such as aluminum or magnesium, etc. The handle 1710 may also have an end cap 1723 that is attached to the distal end 1721 of the handle 1710. The taping knife handle 1710 may be attached to the blade 1705 in a permanent manner (e.g. welding, epoxy adhesive, etc.). The taping knife blade 1705 may be made of a material, for example, a metal. The metal may be, for example, stainless steel, a high carbon steel such as AISI 1060 steel, or AISI 1095 steel, to name a few. In this example, the primary working edge of the blade 1705 may have a portion thereof heat treated, as shown by solid line with a distance of 1725. In variations of this theme, other edges or the entire blade 1705 of the taping knife may also be heat treated if desired. However, heat treating the entire blade 1705 may make the entire length of the thin flattened blade section more brittle and more subject the cracking or breaking at, for example, the area around the handle-to-blade 1715 interface with the blade 1705. As such, it is preferable that at least the working edge may be partially heat treated as shown by, for example, distance 1725, or a distance more or less than distance 1725, rather than completely heat treated, similar to the various embodiments shown and described above. In this case, the heat treatment area 1725 is shown only along one of the edges of the taping knife blade 1705. The heat treatment may be performed using, for example, the process described with respect to FIG. 4 or a similar process for hardening the blade 1705 material so that at least the working edge is more durable, strong, and long lasting. As such, the blade 1705 may be cleaned along one or more sides to be heat treated as indicated shown by the dotted line area, for example area 1727, prior to being heat treated. As noted above relative to other embodiments, one skilled in the art will appreciate that the present invention as embodied in the putty knife building construction tool, is made of a non-disposable blade construction preferably having the blade 1705 securely mounted to a handle 1710 and/or a handle connecting mechanism 1717, e.g., rivets 1771 and 1777, or structure welded to the blade and inserted into the handle-to-blade connection means 1715, and the taping knife 1700 will last longer and will not need to be thrown away or have the heat treated working edge 1725 of the blade 1705 reworked by, for example, manual or machine sharpening (i.e., not simply replacing the blade) as often. Therefore, using the present invention, standard taping knife designs like shown in FIG. 17, that typically do not have quick replacement blade designs or constructions, last much longer before the working surface of the blade 1705 needs reworked of the entire taping knife 1700 is thrown away and a new taping knife 1700 is purchased to replace it.

Figure 18:
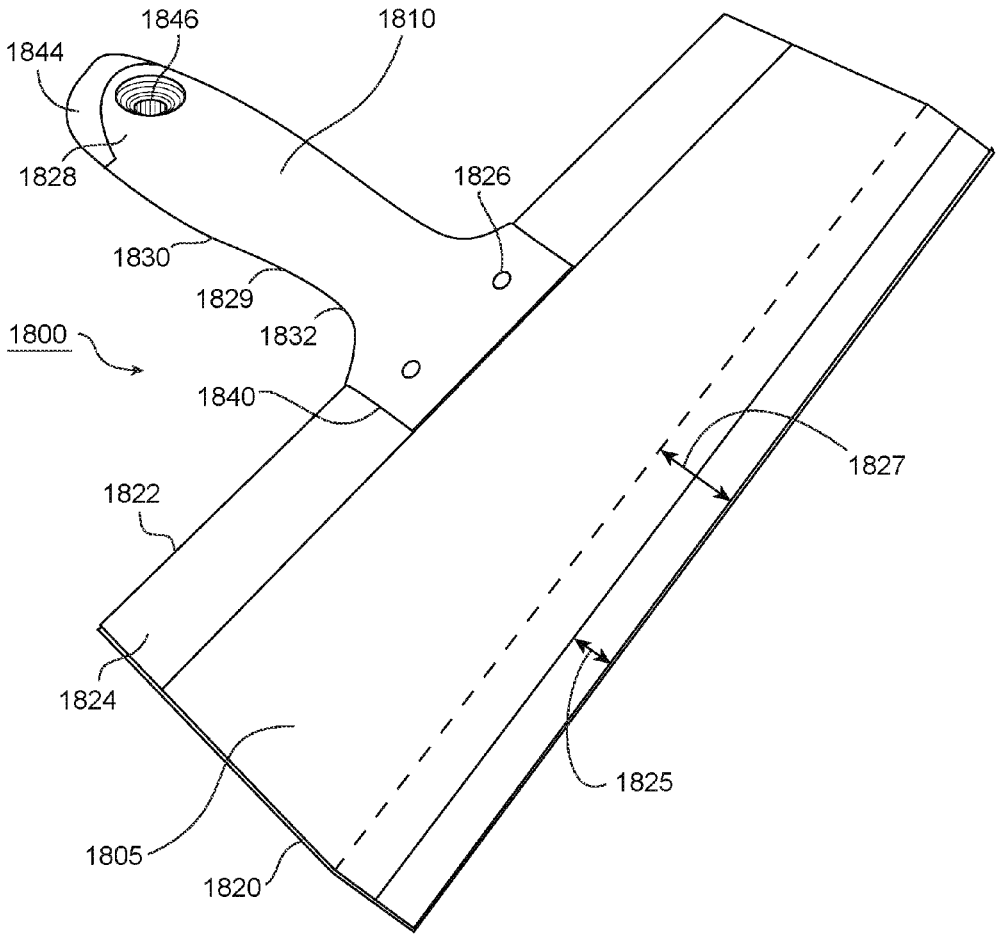
FIG. 18 illustrates another type of building tool, according to at least one embodiment of the invention.

Referring to FIG. 18, a perspective view of another building tool, a taping knife or joint knife 1800 having a slightly different handle-to-blade connection is provided. In this embodiment, the blade 1805 and the handle 1810 may be coupled together with a handle-to-blade mechanism 1824, that may be made of, for example, a plastic or a metal such as aluminum that is wrapped around the upper edge 1822 of the blade 1805. The handle-to-blade mechanism 1824 may be attached to the handle via a grove 1840 in a proximal end of the handle 1810, and the blade 1805 may be couple to the mechanism 1815 via an elongated groove along the mechanism 1824. The handle 1810 may be made of such materials as wood, cork, plastic, molded rubber over one of these materials, light weight metals such as aluminum or magnesium, etc. The handle 1810 may also have an end cap 1844 that is attached to the distal end 1828 of the handle 1810. The taping knife handle 1810 may be attached to the blade 1805 in a permanent manner (e.g. welding, epoxy adhesive, etc.). The taping knife blade 1805 may be made of a material, for example, a metal. The metal may be, for example, stainless steel, a high carbon steel such as AISI 1060 steel, or AISI 1095 steel, to name a few. In this example, the primary working edge of the blade 1805 may have a portion thereof heat treated, as shown by solid line with a distance of 1825. In variations of this theme, other edges or the entire blade 1805 of the taping knife may also be heat treated if desired. However, heat treating the entire blade 1805 may make the entire length of the thin flattened blade section more brittle and more subject the cracking or breaking at, for example, the area around the handle-to-blade 1824 interface with the blade 1805. As such, it is preferable that at least the working edge may be partially heat treated as shown by, for example, distance 1825, or a distance more or less than distance 1825, rather than completely heat treated, similar to the various embodiments shown and described above. In this case, the heat treatment area 1825 is shown only along one of the edges of the taping knife blade 1805. The heat treatment may be performed using, for example, the process described with respect to FIG. 4 or a similar process for hardening the blade 1805 material so that at least the working edge is more durable, strong, and long lasting. As such, the blade 1805 may be cleaned along one or more sides to be heat treated as indicated shown by the dotted line area, for example area 1727, prior to being heat treated. As noted above relative to other embodiments, one skilled in the art will appreciate that the present invention as embodied in the taping knife building construction tool, is made of a non-disposable not replaceable blade construction preferably having the blade 1805 securely mounted to a handle 1810 and/or a handle connecting mechanism 1824, e.g., rivets 1826, or structure welded to the blade and inserted into the handle-to-blade connection means 1826, and the taping knife 1800 will last longer and will not need to be thrown away or have the heat treated working edge 1825 of the blade 1805 reworked by, for example, manual or machine sharpening (i.e., not simply replacing the blade) as often. In one variation, the handle 1810 may be permanently connected to the handle connection mechanism 1824 by molded over plastic and pins there through.

Figure 19A:
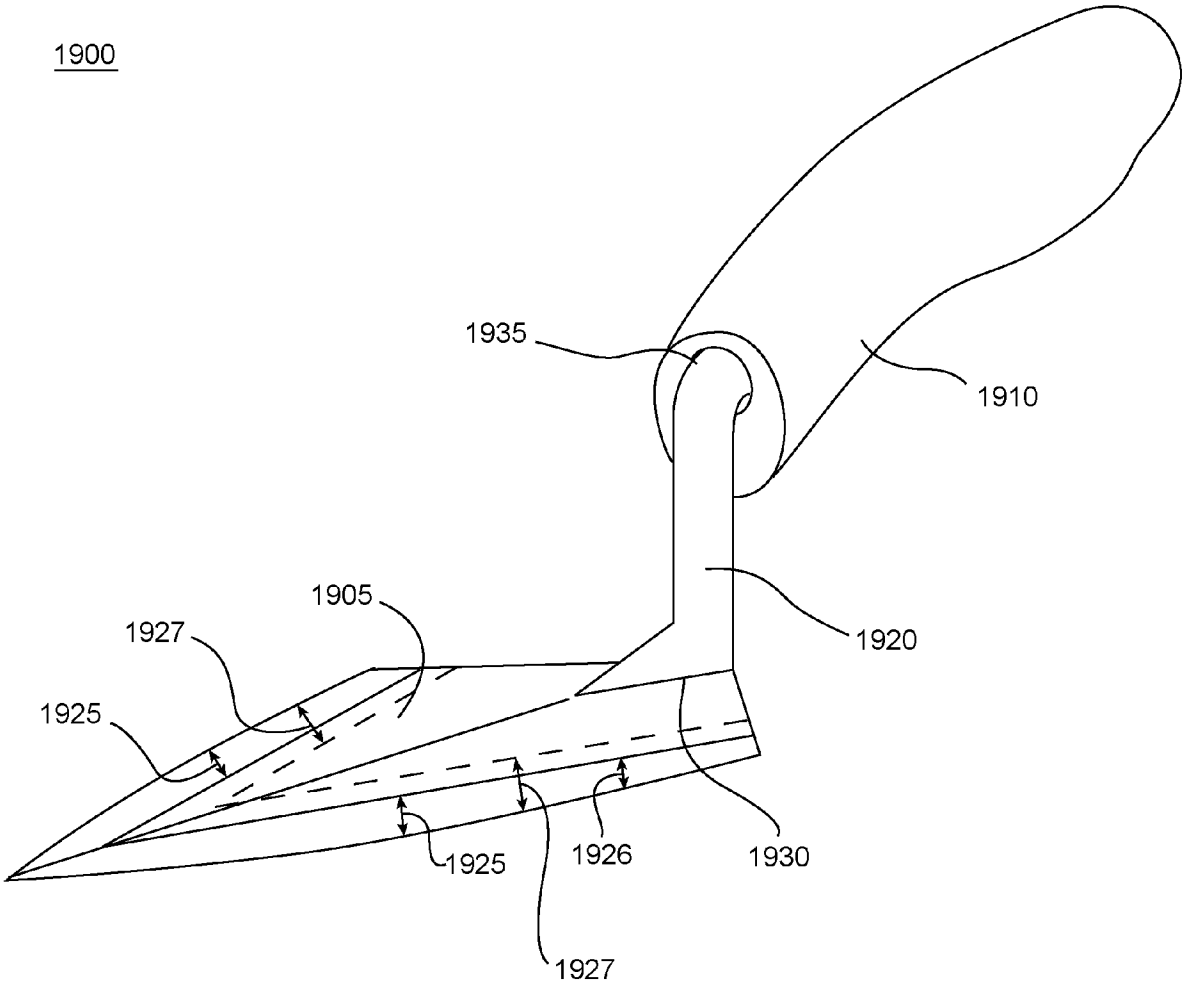
FIGS. 19A and 19B illustrate another type of building tool, according to at least one embodiment of the invention.
Figure 19B:
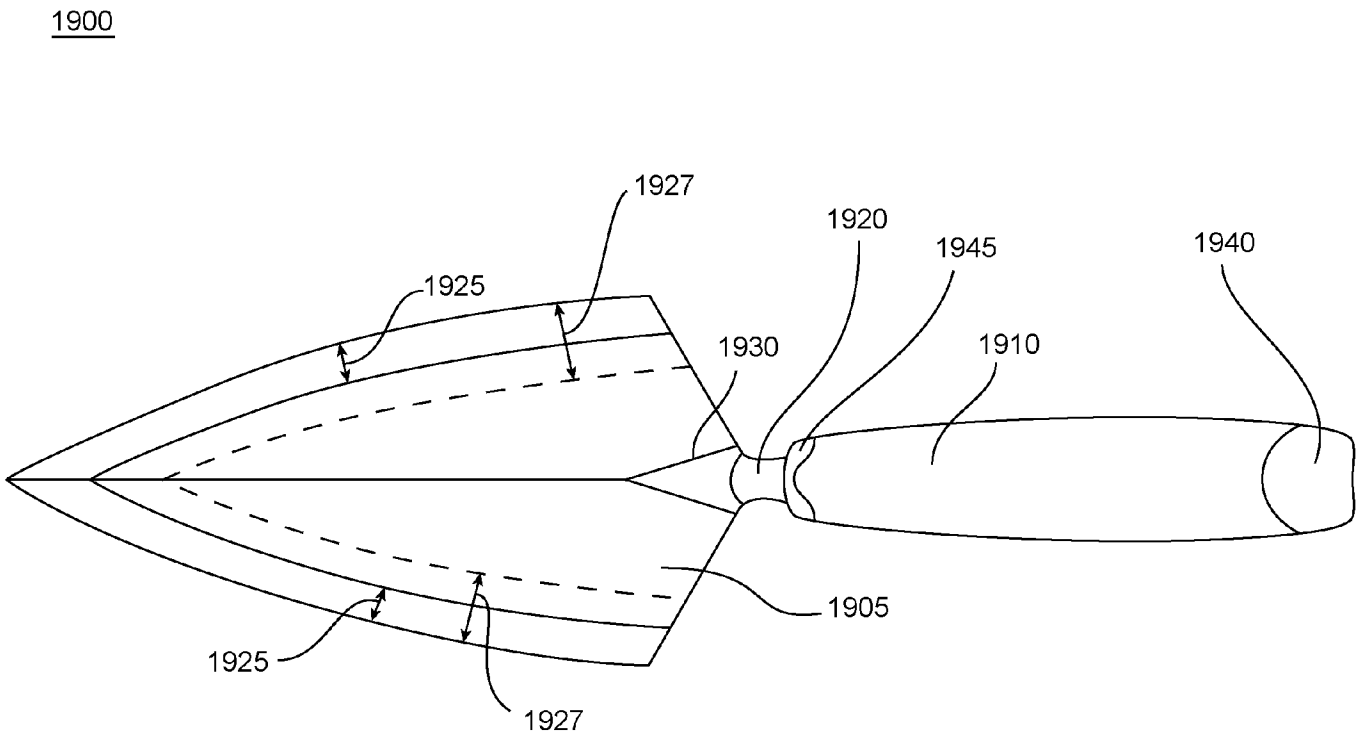

Referring to FIGS. 19A and 19B, a perspective view and plan view, respectively, of a brick trowel or pointing trowel 1900 is provided. One skilled in the art would recognize that the structure of the brick trowel or pointing trowel 1900 may be essentially the same as the finishing trowel described above and may be constructed using the same materials and/or methods. However, the brick trowel or pointing trowel 1900 has a pointed blade 1905. As such, the brick trowel or pointing trowel 1900 includes a handle 1910, a handle-to-blade connection means or a tang 1920, and a blade 1905 permanently attached together. The blade 1905 may be, for example, formed integrally with or welded to the tang 1920 at connection 1930, and may be made of a metal such as those mentioned above. The handle may be made of, for example, wood, plastic, rubber molded over plastic, etc. The tang 1920 may be inserted into at least a portion of the handle 1910 through an opening 1935 in one end of the handle 1910. The blade 1905 may be heat treated along one, two or more of its working surfaces as shown along the perimeter of the blade at a distance from the outside working edge inward shown as solid line 1925 to make the working edges more durable and longer lasting. However, because the working edges of a brick trowel or pointing trowel blade 1905 may have a slight bow or convex shape to them, that distance may vary along the lateral length as show by distance 1926 being less than distance 1925 from the working edge. A cleaning may be performed at a distance 1927 from the working edge as shown by the dotted lines. FIG. 19B shows an embodiment in which the handle 1910 may have and end cap(s) 1940 and/1945, along with a heat treatment that has the same curvature or convex shape of the pointed blade 1905.

Figure 20A:
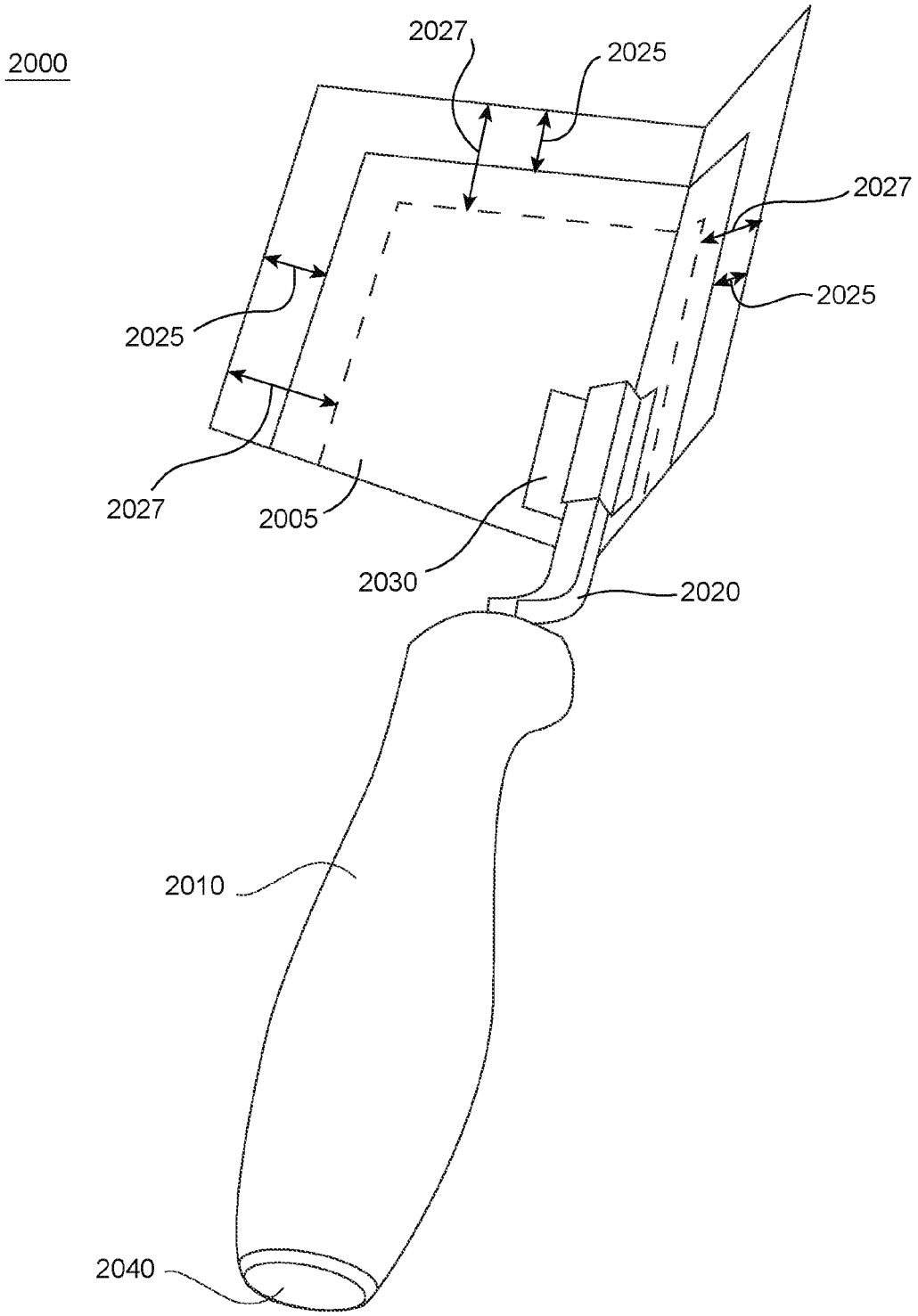
FIGS. 20A and 20B illustrate another type of building tool, according to at least one embodiment of the invention.
Figure 20B:
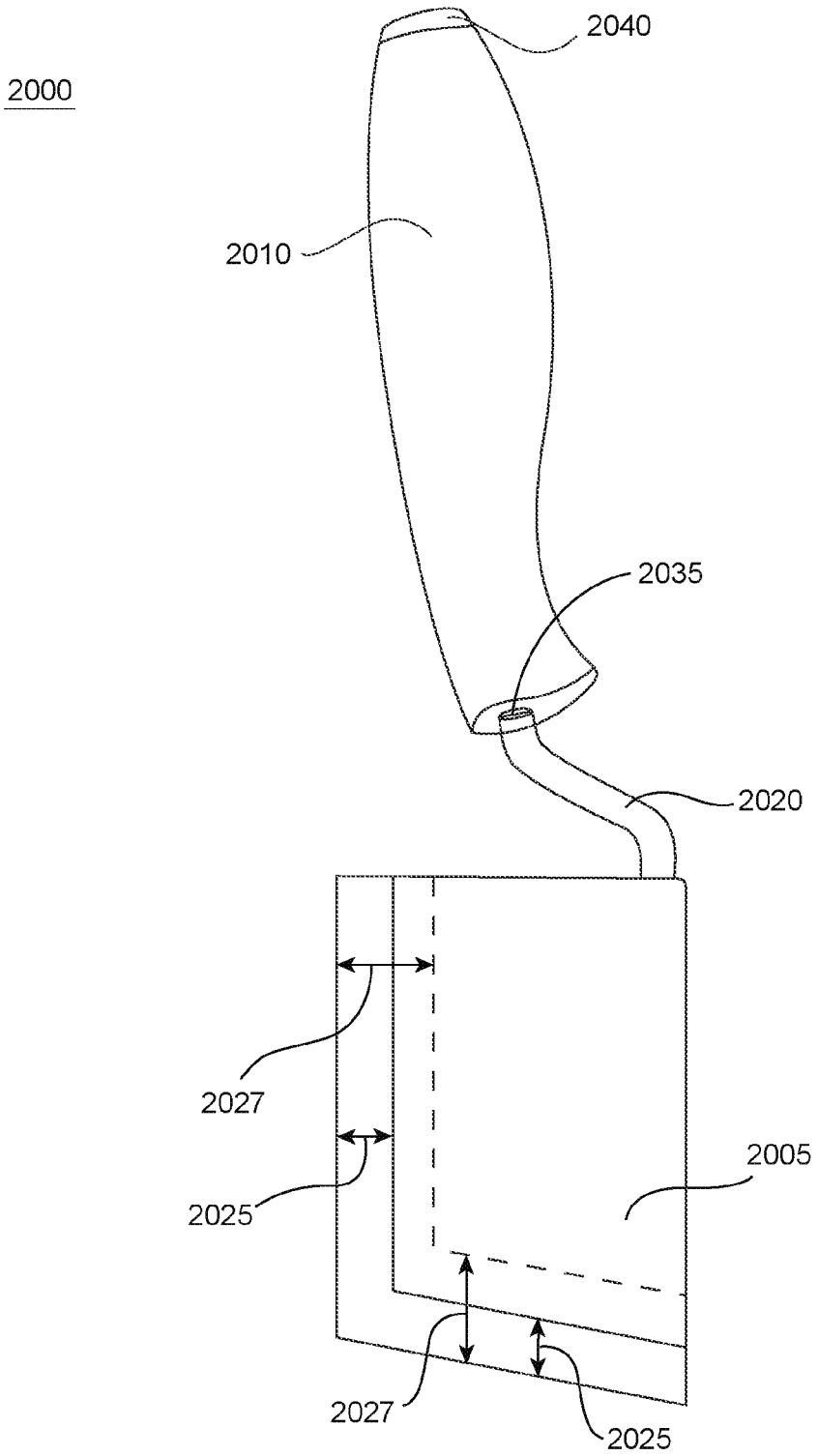

Referring to FIGS. 20A and 20B illustrate a perspective view and a plan view, respectively, of another type of building tool, a corner trowel or corner finishing knife, according to at least one embodiment of the invention. One skilled in the art will recognize that the structure of the corner trowel or corner finishing knife 2000 is similar to the various trowels above in that there is a handle 2010, a blade 2005, and a handle-to-blade connection mechanism or tang 2020, that may be constructed using the same materials and/or methods as described above. However, the corner trowel or corner finishing knife 2000 has a bent or angled blade 2005 that may, for example, have and angle between the two sides of approximately 90 degrees. The corner trowel or corner finishing knife 2000 may also have a means for holding the angled blade 2005 to its intended angle and reinforcing the attachment of the blade 2005 to the tang 2020, an angle assurance and reinforcement mechanism 2030, that may be securely attached to the blade 2005 and the tang 2020 by, for example, welding, brazing, adhesive, etc. The angle assurance and reinforcement mechanism 2030 may be made out of, for example a metal (such as those mentioned above), a plastic, an epoxy resin, etc. As such, the corner trowel or corner finishing knife 2000 includes a handle 2010, a handle-to-blade connection means or a tang 2020, and a blade 2005 permanently attached together. The blade 2005 may be made of, for example, a metal such as those mentioned above. The handle 2010 may be made of, for example, wood, plastic, rubber molded over plastic, etc., and may include an end cap 2040 (or not). The tang 2020 may be inserted into at least a portion of the handle 2010 through an opening 2035 in one end of the handle 2010. The blade 2005 may be heat treated along one, two, or three of its working surfaces as shown along the perimeter of the blade at a distance from the outside working edge inward shown as solid line 1925 to make the working edges more durable and longer lasting. A cleaning may be performed at a distance 1927 from the working edge as shown by the dotted lines.

Figure 21A:
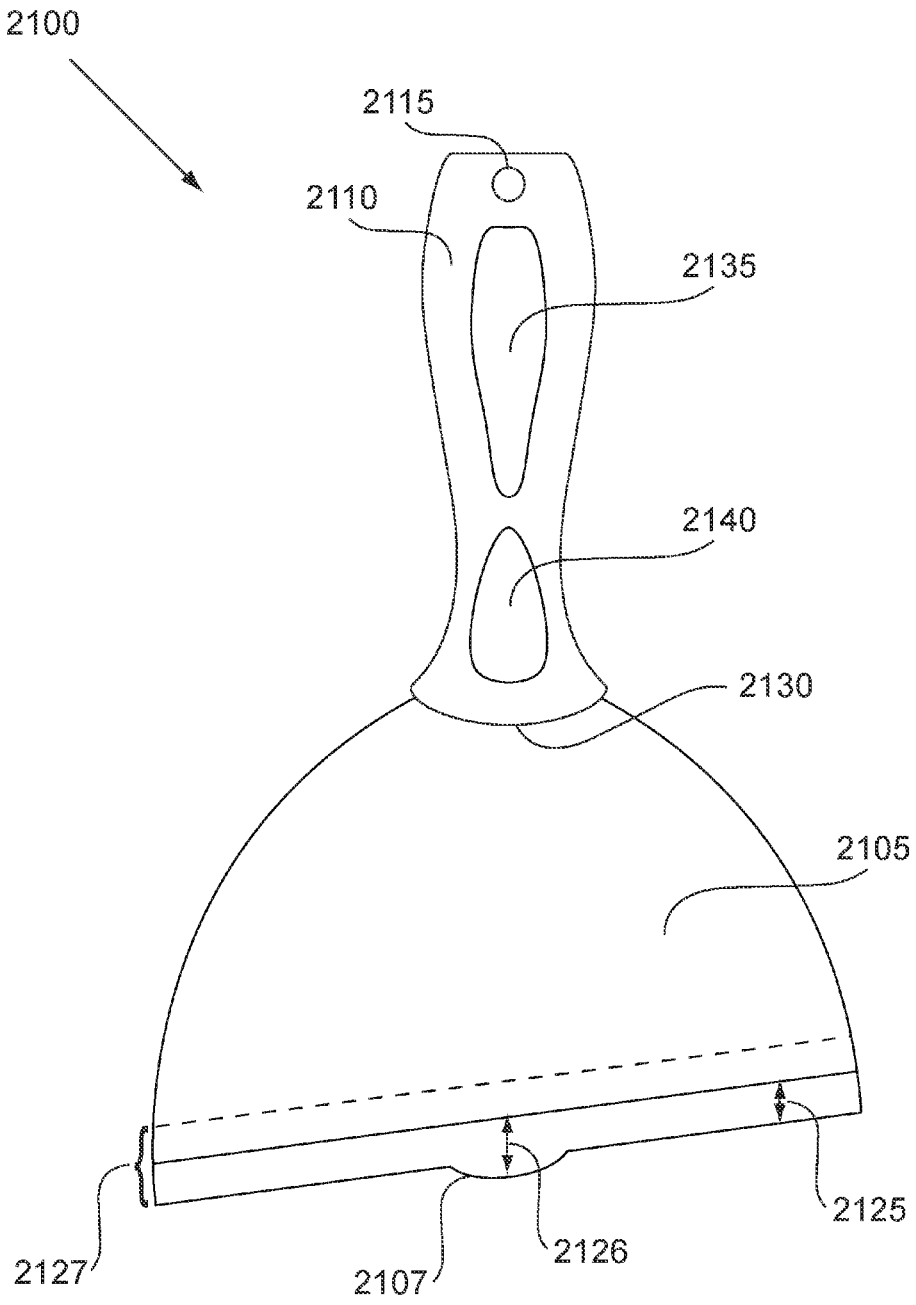
FIGS. 21A and 21B illustrate another type of building tool, according to at least one embodiment of the invention.
Figure 21B:
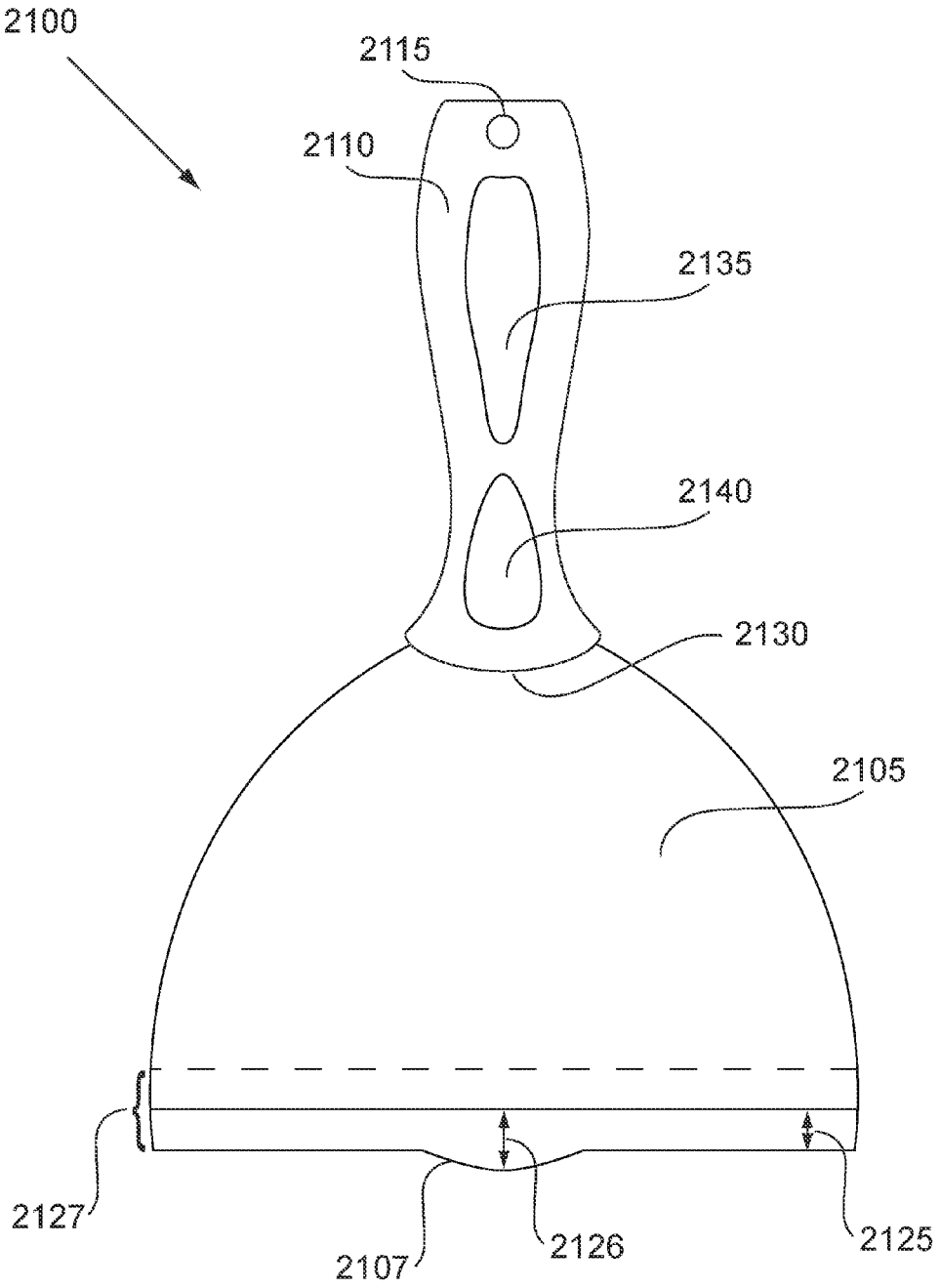

Referring now to FIGS. 21A and 21B, these figures illustrate a perspective view and plan view of a notched taping knife 2100, another type of building tool, according to at least one embodiment of the invention. This exemplary notched taping knife 2100 is typical of those used in the building and construction trades and may include a blade 2105 that is reasonably wide, for example six inches with a bump or concave portion 2007 at the center of the working edge of the blade 2105 and may be permanently attached or coupled to a handle 2110 using, for example, a handle comprised of a two sectioned internal handle structure made of plastic (placed on either side of at least a part of the elongated flat blade structure) and a rubber over mold holding that hold the two sectioned handle structure to each other and the blade 2005. In this example, the internal sections 2135 and 2140 of the handle 2110 illustrate either internal handle material that is thick enough to be exposed as an outside surface, and/or a contour portion of the handle 2110. The construction may be the same as or similar to that of the handle shown above in FIGS. 16A-G above. Alternatively, the handle 2110 could permanently attached to the blade 2105 using two rivets (not shown in this embodiment). The interface of the blade 2105 and the handle 2110 occur at area 2130. The handle may also include a hole 2115 there through at the distal end of the handle (away from the working end of blade 2105). In such a construction, handle structure with rubber over mold may be used to permanently secure the two plastic handle sections (together on either side of the flat elongated blade 2105 material or handle-to-blade connection mechanism). The notched taping knife 2100 blade 2105 may be made of a material, for example, a metal. The metal may be, for example, a stainless steel, a high carbon steel such as AISI 1060 steel or AISI 1095 steel, to name a few. In this example, the primary working edge of the blade 2105 may have a portion thereof heat treated, as shown by solid line with a distance of 2125. In variations of this theme, other edges or the entire blade 2105 of the notched taping knife 2100 may also be heat treated if desired. However, heat treating the entire blade 2105 may make the entire length of the flattened blade section and integral elongate handle connection mechanism more brittle and more subject to cracking or breaking at, for example, the area around the handle-to-blade interface 2130 or where a handle-to blade attachment means would be permanently attached to the blade 2130 (again, one may consider the portion of the flat metal from the blade area 2105 extending into the handle 2110 as being a handle-to-blade attachment mechanism or tang, as it performs the same function even though made integral to the blade in this example). As such, it is preferable that at least the working edge may be partially heat treated as shown by, for example, distance 2125, or a distance more or less than distance 2125, rather than completely heat treated, similar to the various embodiments shown and described above. The heat treatment may be performed using, for example, the process described with respect to FIG. 4 or a similar process for hardening the blade 2165 material so that at least the working edge is more durable, strong, and long lasting. As such, the blade 2105 may be cleaned along one or more sides to be heat treated as indicated shown by the dotted line area, for example area 2127, prior to being heat treated. As noted above relative to other embodiments, one skilled in the art will appreciate that the present invention as embodied in the notched taping knife 2100 building construction tool, is made of a non-disposable permanently attached blade construction preferably having the blade 2105 securely mounted to a handle 2110 and/or a handle connecting mechanism (inside the handle 2110, not shown here) and the notched taping knife 2100 will last longer and will not need to be thrown away or have the working edge area end of the blade 2105 reworked by, for example, manual or machine sharpening (i.e., not simply replacing the blade) as often. Therefore, using the present invention, standard notched taping knife 2100 designs like shown in FIGS. 21A and 21B, that typically do not have quick replacement blade designs or constructions, last much longer before the working surface of the blade 2105 needs reworked of the entire notched taping knife 2100 is thrown away and a new notched taping knife 2100 is purchased to replace it. As noted above since the blade 2105 is sufficiently wide, e.g., six inches or more, than this tool may be considered a taping knife rather than a putty knife or spackle knife.

Figure 22:
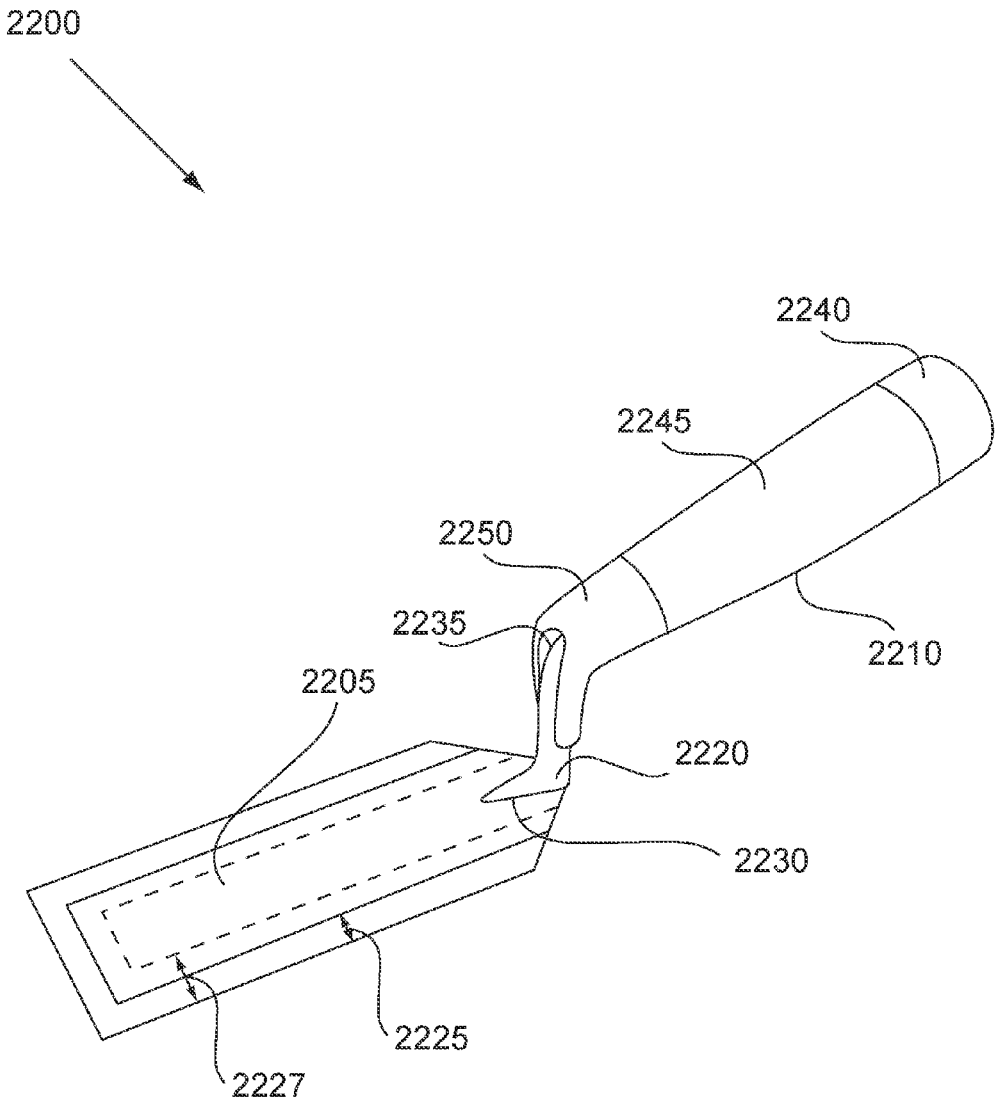
FIG. 22 illustrates another type of building tool, according to at least one embodiment of the invention.

Referring to FIG. 22 a perspective view of a margin trowel, another type of building tool, is provided, according to at least one embodiment of the invention. One skilled in the art will recognize that the structure of the margin trowel 2200 is similar to or the same as the various trowels above in that there is a handle 2210, a blade 2205, and a handle-to-blade connection mechanism or tang 2220, that may be constructed using the same materials and/or methods as described above. However, the margin trowel 2200 has a smaller narrower blade 2205 that may allow its blade 2205 to be formed by stamping a rode of metal flat that is also used to make the tang 2220. As such, the blade 2205 and the tang 2220 may be more easily made as one contiguous integral piece of material, but having different shapes and purposes, so that the tang 2220 does not need to be permanently attached to the blade 2205 by, for example, welding, brazing, etc., at inflection point 2330. As such, the margin trowel 2200 may include a handle 2210, a handle-to-blade connection means or a tang 2220, and a blade 2205, permanently attached together. The blade 2205 may be made of, for example, a metal such as those mentioned above or others that will meet the characteristics needed for the tool's intended use(s). The handle 2210 may be made of, for example, wood, plastic, rubber molded over plastic, etc., and may include an end cap 2240 or 2250 (or not). The tang 2220 may be inserted into at least a portion of the handle 2210 through an opening 2235 in one end of the handle 2210. The blade 2205 may be heat treated along one, two, or three of its working surfaces as shown along the perimeter of the blade at a distance 2225 from the outside working edge inward shown as solid line 2225 to make the working edges more durable and longer lasting. A cleaning may be performed at a distance 2227 from the working edge as shown by the dotted lines.

Figure 23:
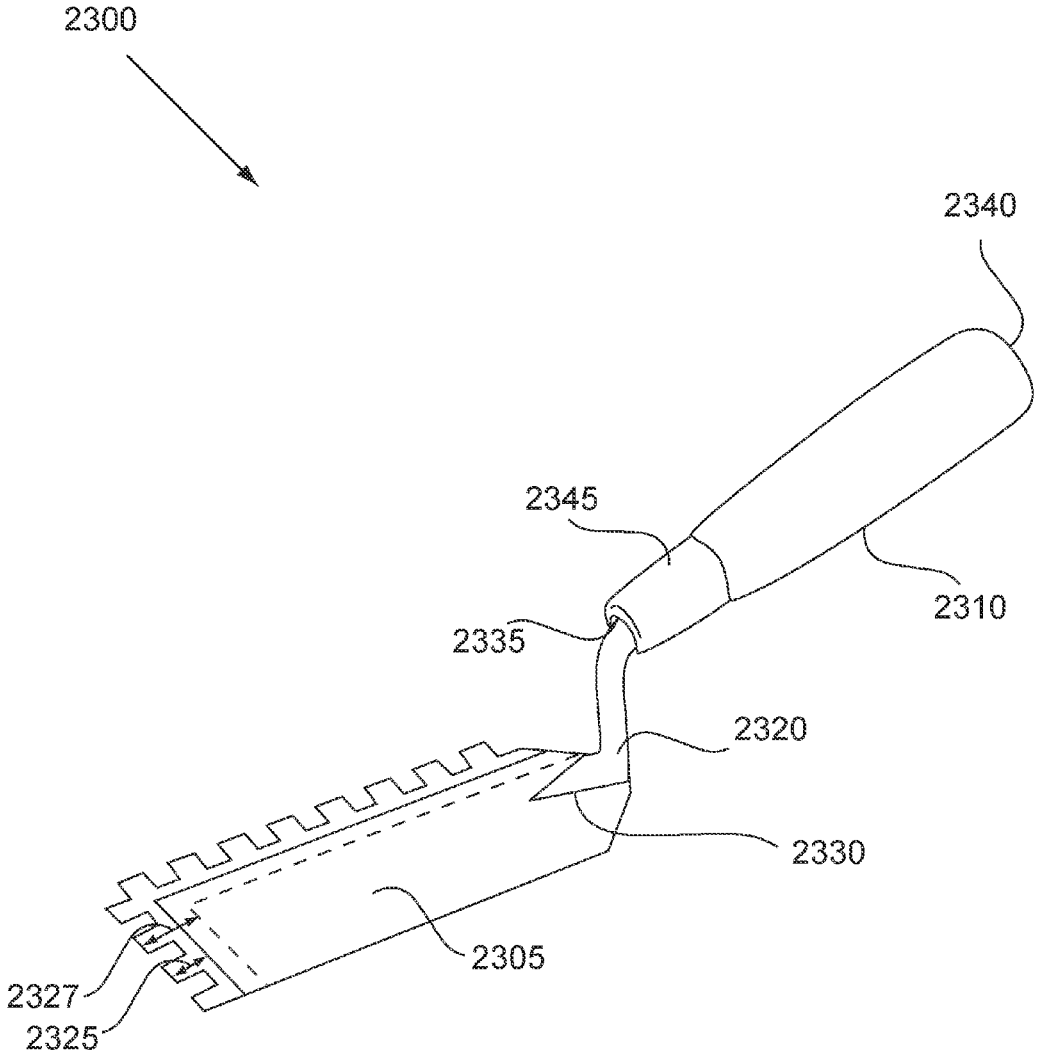
FIG. 23 illustrates another type of building tool, according to at least one embodiment of the invention.

Referring to FIG. 23 a perspective view of a notched margin trowel 2300, another type of building tool, is provided, according to at least one embodiment of the invention. One skilled in the art will recognize that the structure of the notched margin trowel 2200 is the same as the margin trowel 2200 above except that one or more of the working edges of the blade 2305 may be notched; two such notched working edges are shown in the exemplary embodiment of FIG. 23. As such, the notched margin trowel 2300 has a handle 2310, a blade 2305, and a handle-to-blade connection mechanism or tang 2320, that may be constructed using the same materials and/or methods as described above. As with the margin trowel 2200, the notched margin trowel 2300 may have a smaller narrower blade 2305 that may allow its blade 2305 to be formed by stamping a rode of metal flat that is also used to make the tang 2320. As such, the blade 2305 and the tang 2320 may be more easily made as one contiguous integral piece of material, but having different shapes and purposes, so that the tang 2320 does not need to be permanently attached to the blade 2305 by, for example, welding, brazing, etc., at inflection point 2330. As such, the notched margin trowel 2300 may include a handle 2310, a handle-to-blade connection means or a tang 2320, and a blade 2305, permanently attached together. The blade 2305 may be made of, for example, a metal such as those mentioned above or others that will meet the characteristics needed for the tool's intended use(s). The handle 2310 may be made of, for example, wood, plastic, rubber molded over plastic, etc., and may or may not include an end cap 2340 or 2345 (or not). The tang 2320 may be inserted into at least a portion of the handle 2310 through an opening 2335 in one end of the handle 2310. The blade 2305 may be heat treated along one, two, or three of its working surfaces as shown along the perimeter of the blade at a distance 2325 from the outside working edge inward shown as solid line 2325 to make the working edges more durable and longer lasting. A cleaning may be performed at a distance 2327 from the working edge as shown by the dotted lines.

Figure 24A:
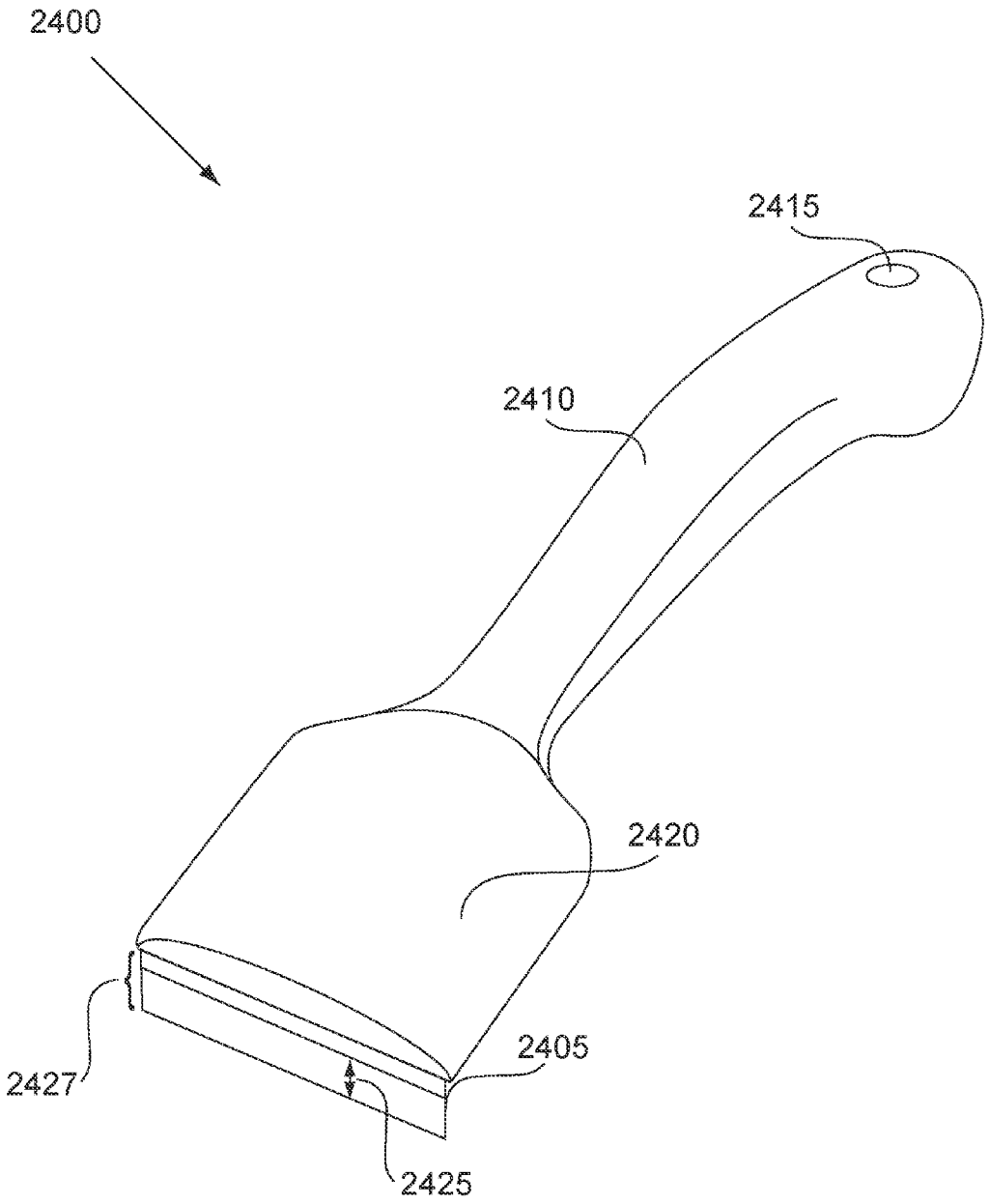
FIGS. 24A and 24B illustrate another type of building tool, according to at least one embodiment of the invention.
Figure 24B:
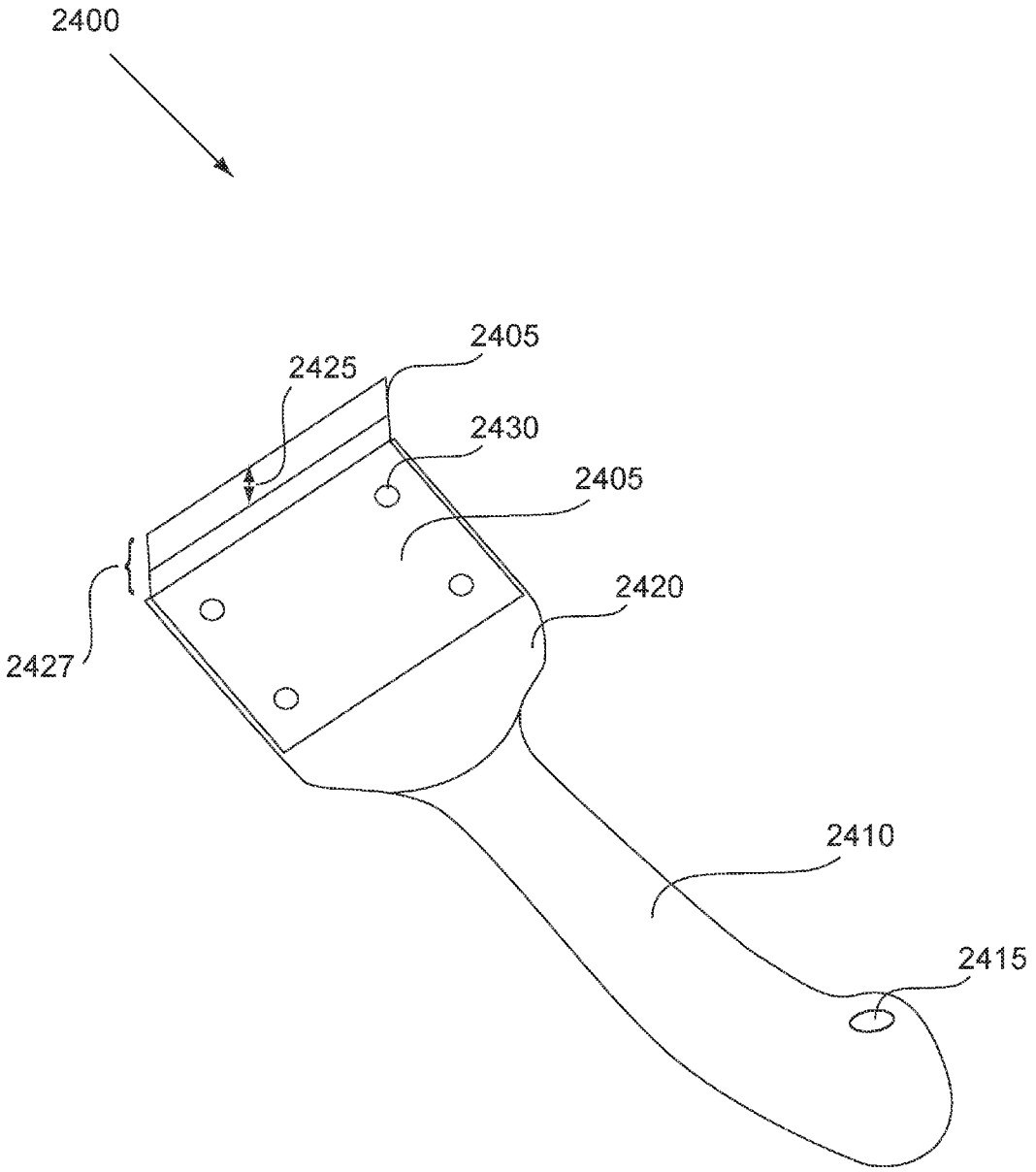

Referring to FIGS. 24A and 24B a top perspective view and bottom perspective view, respectfully, of a heavy duty paint scraper 2400 are provided to illustrate another type of building tool, according to at least one embodiment of the invention. In this embodiment, one skilled in the art will appreciate that the blade 2405 may be bent and may be made of a very rigid metal material so as to retain that bent structure form while under pressure during extended use (although the previously mentioned metals would work). As such, it is more likely that the entire blade 2405 of this particular design of paint scraper may be heat treated to improve the performance and longevity of not just one or more working edges, but the entire blade. In any case, the paint scraper 2400 may have an elongated handle 2410, a blade 2405, and a handle-to-blade connection mechanism or head 2420 to connect the handle to the blade. In a preferred embodiment, the handle 2410 and the handle-to-blade connection mechanism 2420 may be formed of one integrally formed structure by, for example, being made of a molded hard plastic. machined or carved wood, or cast metal such as aluminum or magnesium (lightweight). However, it is sufficient if the handle 2410 and the handle-to-blade connection mechanism or head 2420 are formed separately and then permanently affixed to one another after they are formed. In any case, the blade 2405 may be attached to the handle-to-blade connection mechanism or head 2420 using a permanent connection means, for example, a rivet 2430. Alternatively, the blade 2405 could be permanently attached to the handle-to-blade connection mechanism or head 2420 by using injection molding to mold at least the handle-to-blade connection mechanism or head 2420 around the large part of the blade 2405 (see bottom view in FIG. 24B). The handle may include a hole 2415 there through. The blade 2405 may be heat treated along at least one of its working surfaces or edges as shown along the perimeter of the blade at a distance 2425 from the outside working edge inward shown as solid line 2425 to make at least the working edges more durable and longer lasting. A cleaning may be performed at a distance 2327 from the working edge as shown by the bracket to the side of the blade, i.e., the entire bent down portion of the blade 2405. Of course, as previously mentioned with respect to other embodiment of the invention, the heavy duty paint scraper 2400 is intended to have a permanently attached blasé 2405 that will last longer by the heat treatment of the blade or a portion thereof so that the entire heavy duty paint scraper 2400 lasts longer and does not need to be replaced as often.

Figure 25A:
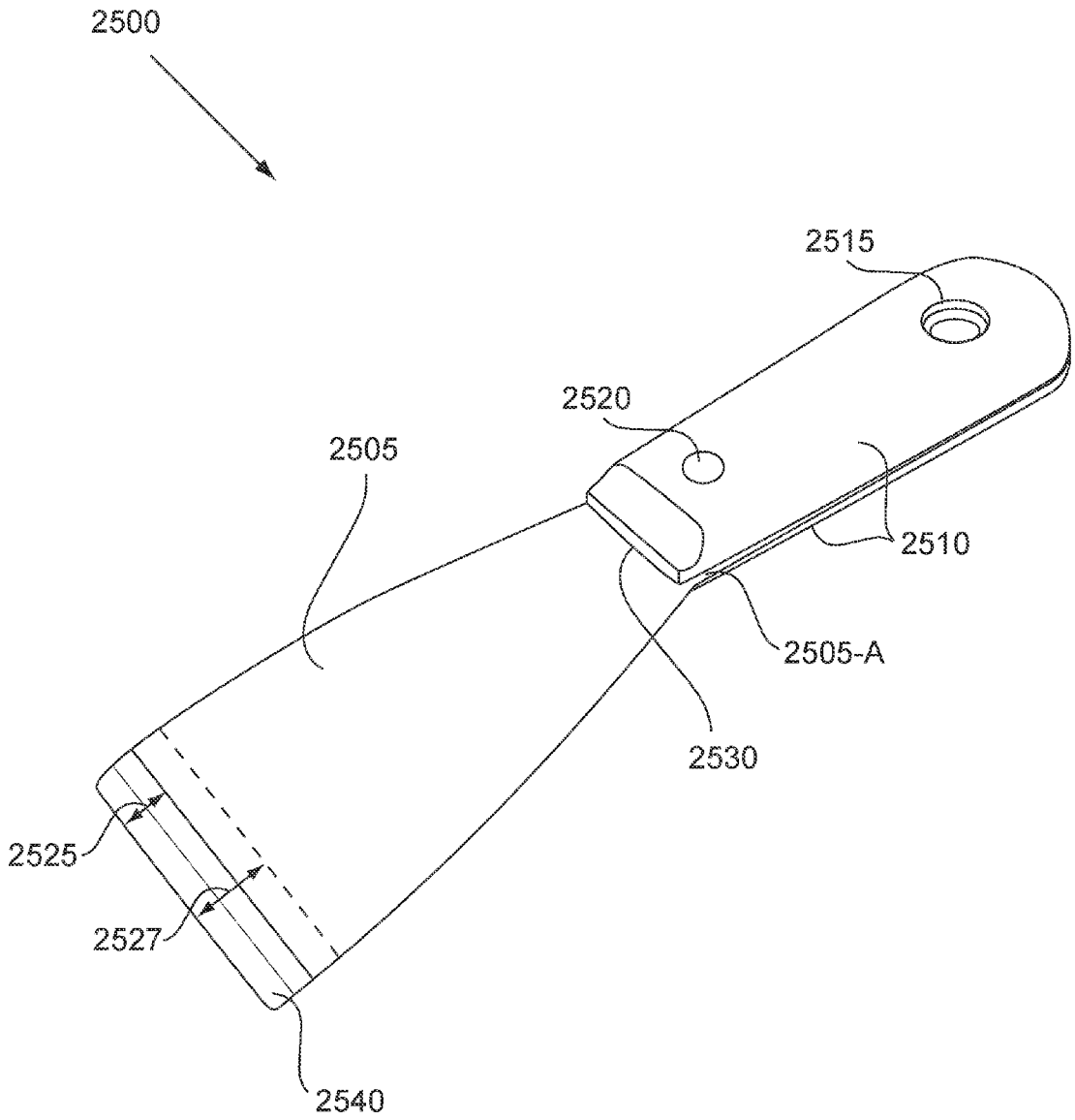
FIGS. 25A and 25B illustrate another type of building tool, according to at least one embodiment of the invention.
Figure 25B:
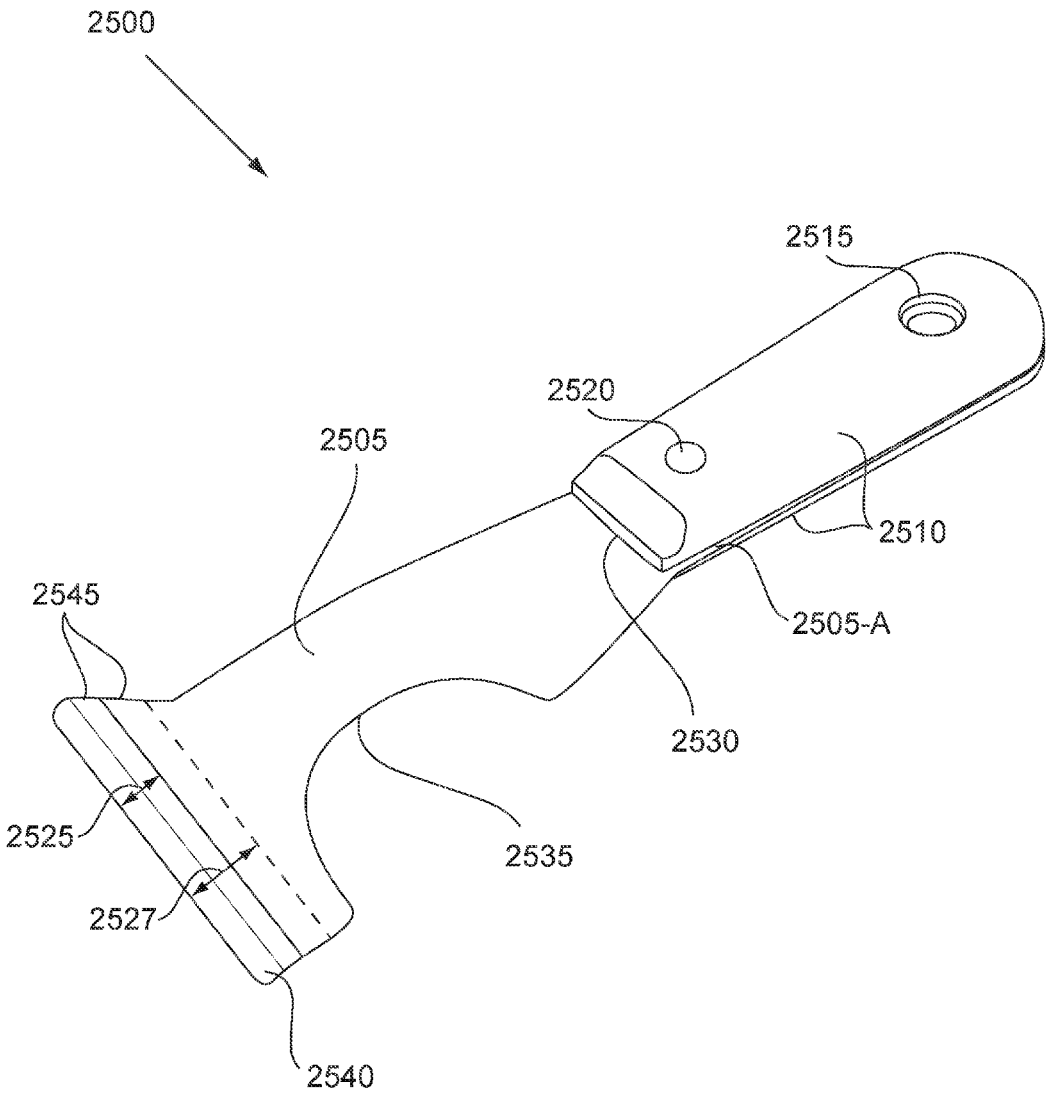

Referring to FIGS. 25A and 25B, perspective views of two other types of paint scrapers 2500 that illustrate another type of building tool are provided, according to at least one embodiment of the invention. One skilled in the art will appreciate that the paint scrapers shown in FIGS. 25A and 25B are similar in many respects to the putty knife and spackle knifes shown above in FIGS. 15-16G, but typically the paint scraper will have at least two distinct differences including a sharp beveled edge 2540 on its primary working edge and a stronger and more firm or rigid base blade material. As such, like the paint scraper 2400 above, these paint scrapers are more likely that the entire blade 2505 of this particular design of paint scraper may be heat treated to improve the rigidity, firmness, performance and longevity of not just one or more working edges, but the entire blade 2505. This exemplary paint scraper 2500 is used in the building and construction trades and may include a blade 2505 that may be permanently attached or coupled to a handle 2510 using, for example, rivets 2515 (with a opening in the center) and 2520. The interface of the blade 2505 and the handle 2510 occur at line 2530, and may be where they are in close proximity to each other when viewed from the side, having the hand composed of two separate pieces on either side of the continuation of the blade 2505 extending the entire length of the paint scraper 2500. In such a construction, the rivets 2515 and 2520 may be used to permanently secure the two handle sections (only one clearly shown in these perspective views, the bottom half is barely visible) together on either side of the flat elongated blade 2505A material. In one variation, the two handles may be permanently held together and to the blade using a two piece core and an over mold to hold the two pieces together (as shown in FIGS. 16A-G).

The paint scraper handle 2510 may be made of one of numerous materials, for example, wood, cork, plastic, rubber, etc., that may be two hollow or solid pieces, or have a hole through the center to accommodate a means of attaching the handle 2510 to the blade 2505 in a permanent manner (e.g. welding, epoxy adhesive, etc.). The paint scraper blade 2505 may be made of a material, for example, a metal. The metal may be, for example, a high carbon steel such as AISI 1060 steel or AISI 1095 steel, stainless steel, etc., to name a few, that has high strength and rigidity (perhaps from heat treating the entire blade). In this example, the primary working edge of the blade 2505 may be beveled 2540 and may have a portion thereof heat treated, as shown by solid line with a distance of 2525. In variations of this theme, other edges, for example, angled edge 2545 (that may be used for opening or cleaning paint can lids and/or sealing groves) and semicircle 2535, or the entire blade 2505 of the paint scraper 2500 may also be heat treated if desired. However, as previously noted heat treating the entire blade 2505 may make the entire length of the flattened blade section more brittle and more subject to cracking or breaking at, for example, the area around the handle-to-blade interface 2530. As such, it may be preferable in some cases that uses a base metal that is already sufficiently sturdy and rigid, that instead one or more of only the working edges may be heat treated as shown by, for example, distance 2525, or a distance more or less than distance 2525, rather than completely heat treating the entire length of the blade 2505 and handle connection means 2505-A. In this case, as an example, the heat treatment area 2525 is shown only along one of the edges of the paint scraper blade 2505. The heat treatment may be performed using, for example, the process described with respect to FIG. 4 or a similar process for hardening the blade 2505 material so that at least the working edge is more durable, strong, and long lasting. As such, the blade 2505 may be cleaned along one or more sides to be heat treated as indicated shown by the dotted line area, for example area 2527, prior to being heat treated. As noted above relative to other embodiments, one skilled in the art will appreciate that the present invention as embodied in the putty knife building construction tool, is made of a non-disposable blade construction preferably having the blade 2505 securely mounted to a handle 2510 and/or a handle connecting mechanism 2505-A or rivets 2515 and 2520 (or structure welded to the blade and inserted into the handle) and the paint scraper will last longer and will not need to be thrown away or have the heat treated working edge 2525 of the blade 2505 reworked by, for example, manual or machine sharpening (i.e., not simply replacing the blade) as often. Therefore, using the present invention, standard paint scraper designs like shown in FIG. 25, that typically do not have quick replacement blade designs or constructions, last much longer before the working surface of the blade 2505 needs reworked of the entire paint scraper 2500 is thrown away and a new paint scraper 2500 is purchased to replace it. Note that FIG. 25B provides additional features, angle out side 2545 and cut out semicircle 2535 and their working surfaces.

Although a particular embodiment(s) of the present invention has been shown and described, it will be understood that it is not intended to limit the invention to the preferred embodiment(s) and it will be obvious to those skilled in the art that various changes and modifications may be made without departing from the spirit and scope of the present invention. For example, the heating and cooling process of the present invention for hardening or strengthening blades may also be applied to other tools, for example, putty knifes, paint scrapers, notched margin trowels (V and/or square notches), notched taping knifes, brick trowels, pointing trowels, margin trowels, trowels with non-rectangular shaped blades, etc, where long term abrasive use may disadvantageously alter the original shape of the tool and/or tool blade. Further, other methods may be used for increasing the durability of the tools working edges (e.g., teeth, etc.), such as attaching (e.g., welding, adhesive, etc.) a more durable material to the tool blade as the work surface. Thus, the invention is intended to cover alternatives, modifications, and equivalents, which may be included within the spirit and scope of the invention as defined by the claims.

All publications, patents, and patent applications cited herein are hereby incorporated by reference in their entirety for all purposes.

What is claimed is:

1. A putty knife, comprising:

a substantially planar permanent non-disposable blade made of a base material and having only selected working edge portion(s) of the blade that are made harder than the base material, a handle that is coplanar with and connected to the blade at an edge portion of the blade distinct from the working edge made of the base material that has not been made harder, whereby the permanent non-disposable blade is made more durable so as to have a longer useful life with improved durability, strength and/or resistance against wear and the blade-to-handle connection is made more durable so that the putty knife does not need to be reworked or disposed of as often.

2. The putty knife of claim 1, wherein the base material is a metal and the selected portion(s) of the blade has been made more durable by being heat treated.

3. The putty knife of claim 2, wherein at least one working surface of the blade is heat treated.

4. The putty knife of claim 3, wherein the working surface of the blade is an edge surface of the blade.

5. The putty knife of claim 3, wherein the heat treating includes induction heating.

6. The putty knife of claim 3, wherein the metal is a high carbon steel.

7. The putty knife of claim 1, wherein the base material is a metal, the selected portion(s) is on at least one perimeter surface(s) of the blade, and the handle is permanently connected to the blade.

8. An apparatus, comprising:

a building construction tool for applying and spreading building material, the building construction tool including;

a substantially planar permanent non-disposable blade made of a base material and having only selected working edge portion(s) of the blade that are made harder than the base material; and a handle that is coplanar with and connected to an edge portion of the blade distinct from the working edge, whereby the blade is made more durable so as to have a longer useful life with improved durability, strength and/or resistance against wear and the handle-to-blade connection is made more durable so that the blade does not need to be reworked or the building construction tool disposed of as often.

9. The apparatus of claim 8, wherein the material is a metal and the selected portion(s) of the blade has been made more durable by being heat treated.

10. The apparatus of claim 9, wherein at least one working surface of the blade is heat treated.

11. The apparatus of claim 10, wherein the working surface of the blade is an edge surface of the blade.

12. The apparatus of claim 10, wherein the heat treating includes induction heating.

13. The apparatus of claim 10, wherein the metal is a high carbon steel.

14. The apparatus of claim 8, further comprising:

a handle-to-blade connection mechanism permanently attached to the permanent non-disposable blade at a portion of the blade made of the base material that has not been made harder, wherein the base material is a metal, the selected portion(s) is on at least one perimeter surface(s) of the blade, the handle is permanently connected to the blade, and the building construction tool is a taping knife.

15. An apparatus, comprising:

a building construction tool for removing building material from a surface, the building construction tool including;

a substantially planar blade made of a base material and having only selected working edge portion(s) of the blade that are made harder than the base material; and a handle that is connected to and coplanar with the planar blade at an edge portion distinct from the working edge, whereby the blade is made more durable so as to have a longer useful life with improved durability, strength and/or resistance against wear and the blade-to-tang connection is made more durable so that the building construction tool does not need to be reworked or disposed of as often.

16. The apparatus of claim 15, wherein the material is a metal and the selected portion(s) of the blade has been made more durable by being heat treated.

17. The apparatus of claim 16, wherein at least one working surface of the blade is heat treated.

18. The apparatus of claim 17, wherein the working surface of the blade is an edge surface of the blade and is beveled to a sharp point.

19. The apparatus of claim 17, wherein the metal is a high carbon steel and the heat treating includes induction heating.

20. The apparatus of claim 15, further comprising:

a handle-to-blade connection mechanism permanently attached to the blade at a portion of the blade made of the base material that has not been made harder, wherein the base material is a metal, the selected portion(s) is on at least one perimeter surface(s) of the blade, the handle is permanently connected to the blade, the blade is permanent and non-disposable, and the building construction tool is a paint scrapper.

* * * * *